US008001707B2

(12) United States Patent
Coles

(10) Patent No.: US 8,001,707 B2
(45) Date of Patent: Aug. 23, 2011

(54) MANUALLY-OPERATED WHEELED SNOW SHOVELS WITH STEERABLE SHOVEL BLADES OR PLOWS

(75) Inventor: Peter Coles, Salt Lake City, UT (US)

(73) Assignee: Colesworks, Inc., Salt Lake City, UT (US)

( * ) Notice: Subject to any disclaimer, the term of this patent is extended or adjusted under 35 U.S.C. 154(b) by 101 days.

(21) Appl. No.: 12/406,942

(22) Filed: Mar. 18, 2009

(65) Prior Publication Data

US 2009/0235559 A1 Sep. 24, 2009

Related U.S. Application Data

(60) Provisional application No. 61/037,954, filed on Mar. 19, 2008.

(51) Int. Cl.
*E01H 5/02* (2006.01)

(52) U.S. Cl. ..... 37/265; 294/54.5

(58) Field of Classification Search ..... 37/265, 37/273, 279, 284, 285; 294/50, 50.8, 54.5
See application file for complete search history.

(56) References Cited

U.S. PATENT DOCUMENTS

| | | | | | |
|---|---|---|---|---|---|
| 328,633 | A | | 10/1885 | Angell | |
| 567,391 | A | * | 9/1896 | Hopper | 254/131.5 |
| 813,983 | A | * | 2/1906 | Luney | 294/54.5 |
| 830,871 | A | * | 9/1906 | Wilken | 37/283 |
| 1,389,249 | A | * | 8/1921 | Kitchel | 56/253 |
| 1,514,076 | A | | 11/1924 | Brown | |
| 1,524,639 | A | * | 1/1925 | Grady | 37/284 |
| 1,667,591 | A | * | 4/1928 | Eden | 37/282 |
| 1,683,732 | A | | 9/1928 | Selin | |
| 1,847,133 | A | * | 3/1932 | Nieman | 37/283 |
| 2,388,985 | A | * | 11/1945 | Martin | 37/283 |
| 2,432,780 | A | | 12/1947 | Mader | |
| 2,441,449 | A | * | 5/1948 | Shaw | 37/434 |
| 2,460,560 | A | | 2/1949 | Williams | |
| 2,463,150 | A | * | 3/1949 | Camp | 294/51 |
| 2,470,217 | A | | 5/1949 | McLoughlin | |
| 2,520,606 | A | | 8/1950 | McLoughlin | |
| 2,590,143 | A | | 3/1952 | Adams, Jr. et al. | |
| 2,629,624 | A | | 2/1953 | Nelles | |
| 2,715,786 | A | | 8/1955 | Dorko | |
| 2,720,043 | A | | 10/1955 | Chamberlin | |

(Continued)

FOREIGN PATENT DOCUMENTS

CA 2501109 9/2005

(Continued)

OTHER PUBLICATIONS

Field Corn Planter, http://etc.usf.edu.clipart/4200/4213/planter_5.htm, Mar. 11, 2005, 2 pages.

(Continued)

*Primary Examiner* — Robert Pezzuto
(74) *Attorney, Agent, or Firm* — Harness, Dickey & Pierce, P.L.C.

(57) ABSTRACT

Various exemplary embodiments are provided of wheeled shovels. In one exemplary embodiment, a wheeled shovel generally includes a frame, a wheel, a handle, and a pivotable or steerable shovel blade. A pivot couples the shovel blade to the lower portion of the frame, such that the shovel blade is pivotable or steerable relative to the frame about a pivot axis.

27 Claims, 22 Drawing Sheets

U.S. PATENT DOCUMENTS 2,803,071 A * 8/1957 Pochopien ..... 37/283
2,811,792 A 11/1957 Cork, Jr.
2,846,785 A 8/1958 Underwood
2,852,872 A 9/1958 Benz
2,852,873 A 9/1958 Benz
2,863,232 A 12/1958 Steinbach et al.
2,867,827 A 1/1959 Gantz
2,919,153 A * 12/1959 Benton ..... 294/51
2,930,152 A 3/1960 Pipkin
2,930,252 A 3/1960 Pipkin
2,967,363 A * 1/1961 Meier ..... 37/283
D190,820 S 7/1961 O'Connor
3,019,056 A 1/1962 Kielman
3,078,604 A 2/1963 Neuman
3,097,541 A 7/1963 Kindig
3,107,446 A 10/1963 Messinger
3,136,574 A 6/1964 Pasquale
3,222,699 A 12/1965 Zeisig
3,343,807 A 9/1967 Moraski
3,452,798 A 7/1969 Ravreby
3,468,041 A 9/1969 Mattson et al.
3,469,326 A 9/1969 Malickson
3,475,838 A 11/1969 Hagen et al.
3,526,979 A 9/1970 Ladewski
3,594,932 A 7/1971 Eriksson
3,643,356 A 2/1972 Gohl
3,695,728 A 10/1972 Haussels
3,748,761 A 7/1973 Chetwynde
3,751,058 A 8/1973 Larsen
3,985,932 A 10/1976 Porter
4,046,184 A 9/1977 Diehl
4,055,354 A 10/1977 Sharpe
4,153,287 A 5/1979 Towsend
4,161,073 A 7/1979 Oakes
4,179,828 A 12/1979 Brunty
4,214,385 A 7/1980 Baranowski et al.
4,224,751 A 9/1980 Schoemann et al.
4,231,604 A 11/1980 Obergfell
4,264,095 A * 4/1981 Lemasters ..... 294/53.5
D262,259 S 12/1981 Terpening
4,302,894 A 12/1981 Emma
4,345,633 A 8/1982 Gilmore
4,597,204 A * 7/1986 Heiden ..... 37/285
4,607,860 A 8/1986 Vogel
4,690,447 A 9/1987 Adams
4,704,758 A 11/1987 Hoffman
4,858,348 A 8/1989 Lundy
4,865,373 A 9/1989 Hudson
4,910,893 A 3/1990 Asay
D314,318 S 2/1991 Uimonen
4,996,834 A * 3/1991 Geist ..... 56/400.17
5,018,282 A 5/1991 Hong
5,048,206 A 9/1991 Jones
5,054,278 A 10/1991 Thorndike
5,074,064 A 12/1991 Nickels
5,117,530 A 6/1992 Rank
5,123,187 A 6/1992 Zamaria
5,159,769 A 11/1992 Odorisio
5,279,102 A 1/1994 Foster
5,487,530 A 1/1996 McCullough
5,499,852 A 3/1996 Seigendall
5,511,327 A 4/1996 Jurkowski et al.
5,511,328 A * 4/1996 Fingerer et al. ..... 37/285
D375,235 S 11/1996 Spear et al.
D376,965 S 12/1996 Spear et al.
5,581,915 A 12/1996 Lobato
5,613,354 A 3/1997 Foster
5,727,799 A 3/1998 DiSario
5,762,405 A 6/1998 Dempsey
5,782,240 A 7/1998 Raviv et al.
5,782,518 A 7/1998 Scruggs
5,782,540 A 7/1998 Camfield et al.
5,810,408 A 9/1998 Armstrong
5,826,948 A 10/1998 Schroeder et al.
5,829,808 A * 11/1998 Colla ..... 294/53.5
5,918,921 A 7/1999 Samuelson
D415,663 S 10/1999 Whitehead et al.
5,970,692 A 10/1999 Foster
5,984,393 A * 11/1999 Washington ..... 294/53.5
6,050,576 A 4/2000 Tanner et al.
6,053,548 A 4/2000 Bowles, Jr.
6,139,040 A 10/2000 Dempsey
6,163,986 A 12/2000 Townsend
6,237,975 B1 5/2001 Drobot
6,334,640 B1 1/2002 Werner et al.
6,344,640 B1 2/2002 Rhoads
6,364,424 B1 4/2002 Lashlee et al.
D459,641 S 7/2002 Guneysu
6,457,757 B2 10/2002 Hendrick
6,474,007 B1 11/2002 Sueshige et al.
6,523,839 B2 2/2003 Simmons et al.
6,643,958 B1 11/2003 Krejci
6,675,507 B2 1/2004 Petruzzelli
6,701,913 B1 3/2004 LeDuc et al.
6,735,887 B1 5/2004 Muzzammel
6,922,920 B1 8/2005 Stratz
6,948,268 B1 * 9/2005 Ronca ..... 37/284
D523,710 S 6/2006 Noonan
D525,093 S 7/2006 Noonan et al.
7,100,313 B2 9/2006 Scherer
7,111,418 B2 9/2006 Noonan
D543,807 S 6/2007 Noonan et al.
D546,144 S 7/2007 Noonan et al.
D555,565 S 11/2007 Noonan et al.
7,305,779 B1 12/2007 Purvis
D568,122 S 5/2008 Noonan et al.
7,380,848 B2 * 6/2008 Petruzelli ..... 294/54.5
7,681,933 B2 * 3/2010 Chesness ..... 294/54.5
2001/0045029 A1 * 11/2001 Fulton ..... 37/266
2005/0160632 A1 7/2005 Williams
2005/0160633 A1 7/2005 Noonan
2006/0249964 A1 * 11/2006 Brazeau ..... 294/54.5
2006/0265913 A1 11/2006 Noonan et al.
2007/0013198 A1 1/2007 Brazeau et al.
2007/0227048 A1 10/2007 Adinata

FOREIGN PATENT DOCUMENTS

CN 1699696 11/2005
DE 3717334 A1 * 12/1988
EP 0158032 10/1985
EP EM000729942-0001 5/2007
EP EM000729942-0002 5/2007
FR 865426 5/1941
HK 1083876 7/2006
JP 2005-273450 10/2005
WO WO2005/098142 10/2005
WO WO-2007/025183 3/2007

OTHER PUBLICATIONS

Two Photographs of Wovel® Wheeled Shovel, Jan. 2005.

* cited by examiner

MANUALLY-OPERATED WHEELED SNOW SHOVELS WITH STEERABLE SHOVEL BLADES OR PLOWS

CROSS-REFERENCE TO RELATED APPLICATION

This application claims the benefit of U.S. Provisional Application No. 61/037,954 filed Mar. 19, 2008, the entire disclosure of which is incorporated herein by reference in its entirety.

FIELD

The present disclosure generally relates to manually-operated wheeled snow shovels having steerable or dynamically articulating shovel blades or plows.

BACKGROUND

The statements in this background section merely provide background information related to the present disclosure and may not constitute prior art.

Generally, there are two common types of snow shovels. One type of snow shovel involves lifting and throwing of the snow. The other type of snow shovel involves pushing of the snow like plowing.

SUMMARY

According to various aspects of the present disclosure, there are provided various exemplary embodiments of wheeled shovels having steerable shovel blades or plows. In one exemplary embodiment, a wheeled shovel generally includes a frame, a wheel, a handle, and a shovel blade. A pivot couples the shovel blade to the lower portion of the frame, such that the shovel blade is pivotable relative to the frame about a pivot axis. This, in turn, may allow the user to essentially steer the load on the shovel blade around corners, etc.

In another exemplary embodiment, there is provided a method of using a shovel having a frame and a steerable shovel blade that is pivotably movable relative to the frame about a pivot axis. The pivot axis is not perpendicular to a forward direction of travel of the shovel. The method generally includes leaning the frame towards the left or right direction and moving the shovel in a forward direction, to thereby dynamically pivot or steer the shovel blade about the pivot axis towards the same left or right direction in which the frame is leaning. The method may also include maintaining the shovel blade pivoted to the left or right direction without locking the shovel blade, by application of a force to the shovel blade that is generated as the shovel continues to move in the forward direction with the frame leaning.

In another exemplary embodiment, an apparatus generally includes a tool and a frame having an upper portion and a lower portion. A handle is disposed at about the upper portion of the frame. A pivot couples the tool to the lower portion of the frame. The pivot is configured to allow the tool to pivot relative to the frame about a pivot axis that is not perpendicular to, but tilted in a direction towards, a forward direction of travel of the apparatus. The apparatus is configured such that the tool may be steered or dynamically pivoted, and remains pivoted about the pivot axis towards the left or right direction relative to the forward direction by a force applied to the tool.

The force may be generated as the apparatus is traveling in the forward direction with the frame leaning to the same left or right direction.

Further aspects and features of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

Figure 20:
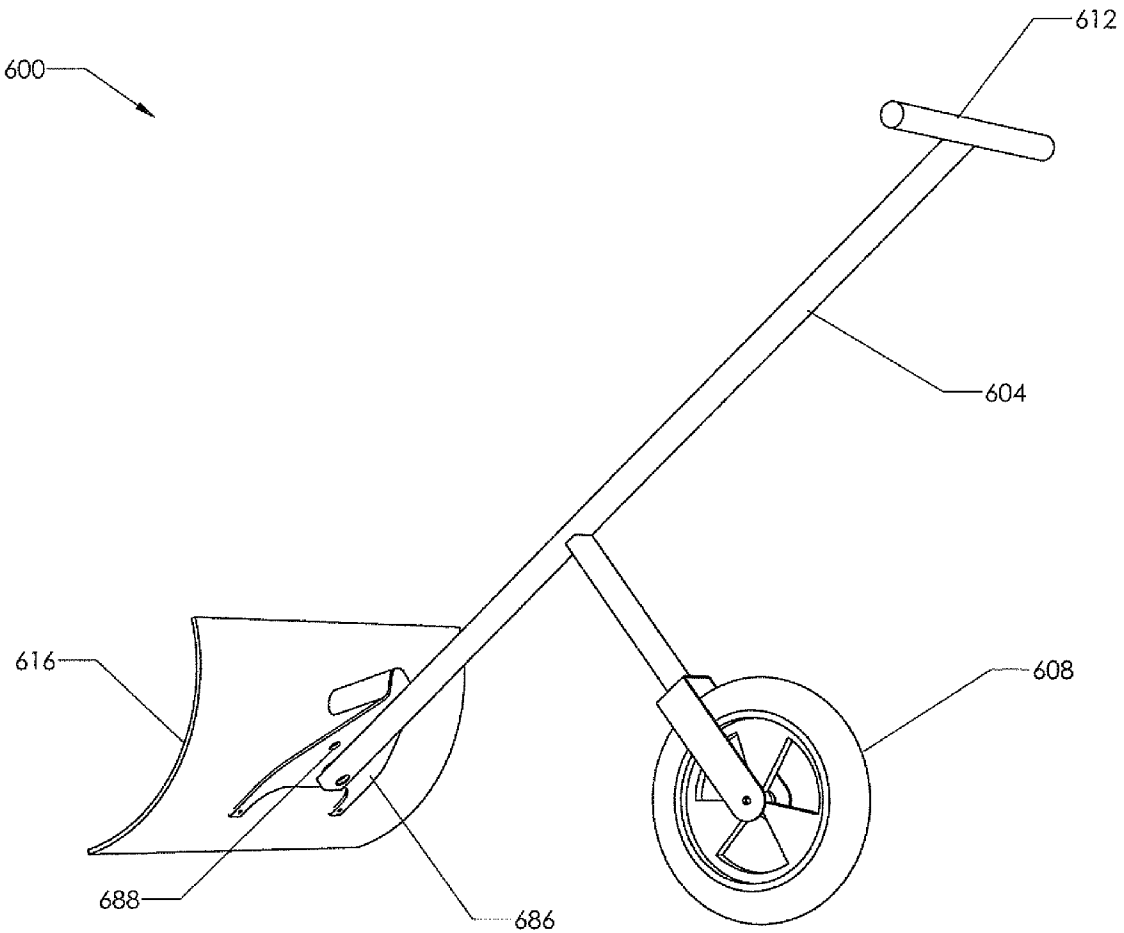
FIG. 20 is a perspective view of another exemplary embodiment of a wheeled shovel having a pivotable/steerable shovel blade.
Figure 22:
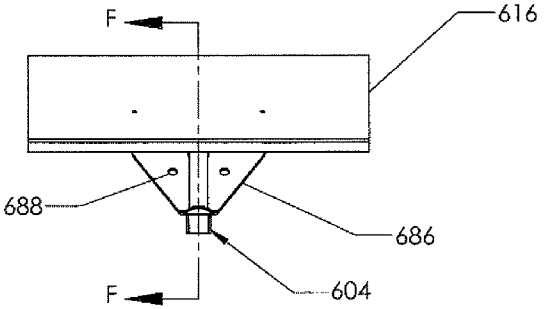
Figure 23:
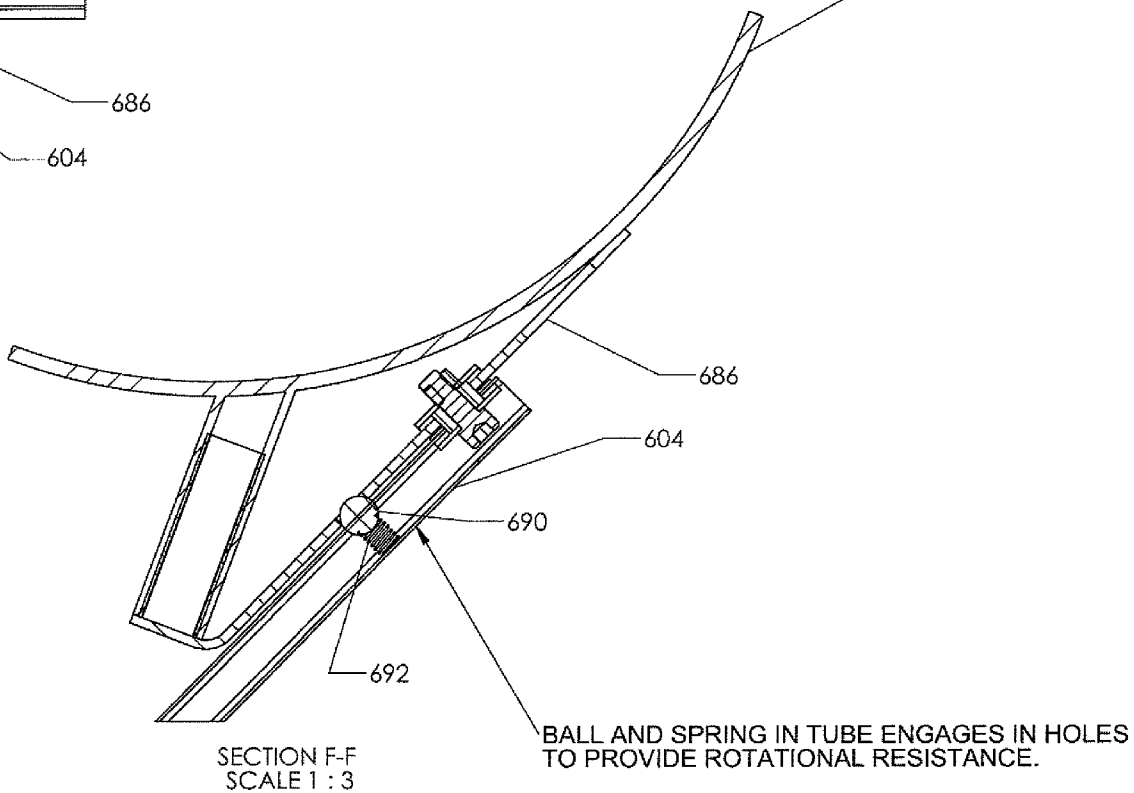

FIG. 22 is an upper view of the shovel blade and coupling of the shovel blade to the frame of the wheeled shovel shown in FIG. 20; and FIG. 23 is a cross-sectional view taken along the plane F-F shown in FIG. 22, and illustrating a detent mechanism that includes a spring and a ball that engages in one of three different holes for helping retain the shovel blade in the corresponding one of three different pivoted or steered configurations associated with the holes.

DETAILED DESCRIPTION

The following description is merely exemplary in nature and is in no way intended to limit the present disclosure, application, or uses.

According to various aspects of the present disclosure, there are provided various exemplary embodiments of wheeled shovels that may be used for pushing, plowing, etc. materials (e.g., snow, gravel, soil, sand, coal, other granular materials, etc.) in an efficient and effective manner. Other embodiments include other wheeled devices and non-wheeled devices. Further aspects relate to methods of using wheeled shovels. Additional aspects relate to apparatus and methods for pivotably connecting a tool (e.g., shovel blade, snow plow, scraper, weeder, etc.) to a forward lower portion of a frame or longitudinal chassis member of a device (e.g., wheeled shovel, non-wheeled shovel, etc.), such that the tool may pivot, swivel, or be steered relative to the forward direction of travel of the device and/or relative to the frame or longitudinal chassis member of the device. Accordingly, the user may lean or tilt the device while the device is moving forward to steer, dynamically articulate, or cause the tool to swivel or pivot towards the left or right during use. As an example, this may allow the user to essentially steer the load (e.g., snow on a shovel blade, etc.) around corners, etc. As another example, the tool in a pivoted/swiveled position may be used to push or plow snow (or other material) generally towards a left or right side of the device, and thus out of the path along which the device is traveling in a generally forward direction. Some embodiments may also include a tool (e.g., cultivator, rake, weeder, etc.) disposed (e.g., removably or fixedly secured, etc.) behind of the pivotably connected tool and/or wheel(s) of the device.

In various exemplary embodiments, a wheeled shovel generally includes one or more wheels. For example, some embodiments may include only a single wheel, while other embodiments include two or more wheels. In addition, wheels of different diameters may also be used, such as a 36-inch diameter wheel or smaller diameter wheel. The wheeled shovel also includes a frame having an upper portion and a lower portion. A handle (e.g., generally T-shaped tubular handle, etc.) may be disposed (e.g., attached, integrally formed, etc.) at about the upper portion of the frame, such that the handle may be operated by the user from behind the wheeled shovel.

A shovel blade or plow is pivotally connected to the lower portion of the frame by a pivot or swivel (e.g., castor without a wheel, etc.). The swivel preferably allows the shovel blade or plow to be steered, swivel, pivot, or dynamically articulate to the left or the right relative to a forward direction of travel of the wheeled shovel during use. For example, the operator may manipulate or twist the handle so as to lean the wheeled shovel towards the right when pushing the wheeled shovel forward, thereby steering or causing the shovel blade or plow to dynamically articulate or pivot towards the left same, right direction (e.g., pivot or swivel about sixty degrees to the right from a longitudinal centerline axis of the frame, etc.). For example, the user may thus essentially steer the shovel blade and a load carried thereby (e.g., snow on a shovel blade, etc.) around corners, etc. As another example, the user may steer, pivot, or swivel the shovel blade to the left to direct, push, or plow snow towards the left and out of the path of the wheeled shovel. Conversely, the operator may instead manipulate or twist the handle so as to lean the wheeled shovel towards the left when pushing the wheeled shovel forward, thereby steering or causing the shovel blade or plow to dynamically articulate or pivot towards the same, left direction (e.g., pivot or swivel about sixty degrees to the left from a longitudinal centerline axis of the frame, etc.). When pivoted or swiveled to the right, the shovel blade or plow may then direct, push, or plow snow towards the right and out of the path of the wheeled shovel.

The wheeled shovel may be configured such that during use, the frame is generally slanted, oblique, and forms an acute angle (e.g., forty-five degrees, thirty degrees, etc.) with the surface (e.g., sidewalk, driveway, road, walkway, etc.) along which the wheel is rolling and from which snow is being removed.

Some wheeled shovel embodiments are configured with a pivot axis for the shovel blade that is not perpendicular relative to the forward direction of travel of the wheeled shovel. For example, the wheeled shovel may be configured such that the shovel blade is steerable or pivotable about a pivot axis generally perpendicular to the longitudinal axis of the frame. Some wheeled shovel embodiments include a shovel blade that is pivotable about a non-vertical axis, which is tilted or angled forward of vertical (e.g., see angle B in FIG. 9, etc.). With the wheeled shovel supported on a horizontal surface (e.g., the wheel and shovel blade in contact with a sidewalk, driveway, road, walkway, etc.), the shovel blade is pivotable or steerable about an axis that is not perpendicular to the horizontal surface (e.g., see angle A in FIG. 9, etc.). Instead, the axis is generally slanted forward and forms an acute angle (e.g., angle A is about sixty degrees, etc.) with the surface (e.g., sidewalk, driveway, road, walkway, or other surface from which snow is being removed, etc.) along which the wheel is rolling and shovel blade is traveling. The inventor hereof has found that the extent how much the axis is angled or tilted forward determines, at least in part, how much the shovel blade pivots for a given handle lean or tilted position.

With a pivot axis that is not perpendicular to the forward direction of travel (e.g., a non-vertical pivot axis that is tilted forward of vertical, etc.), the inventor has also recognized that a locking mechanism is not necessarily required or needed to maintain the shovel blade's pivoted position. The shovel blade position may thus be maintained by the user resisting the torsional or leaning motion of the blade. The shovel blade may remain pivoted to the right or left without requiring a locking mechanism to lock the blade in place.

In embodiments in which the shovel blade is not locked into place after being pivoted or swiveled relative to the frame, the shovel blade's angular orientation relative to the frame may be changed by turning, twisting, or leaning the handle. The shovel blade may freely swivel or pivot with respect to the frame and handle about a pivot axis such that twisting or leaning of the handle (and frame) creates the desired steering or pivotal motion of the shovel blade. The user may change the angle of pivot of the shovel blade relative to the frame during operation by changing the direction or extent that the frame is leaning to one side or the other. For example, the user may lean the wheeled shovel's frame generally towards the left while moving the wheeled shovel in a forward direction, to thereby steer or cause the shovel blade to swivel or pivot to the right. The user may then lean the wheeled shovel's frame generally towards the right while moving the wheeled shovel in a forward direction, to thereby steer or cause the shovel blade to swivel or pivot to the left. Because the shovel blade is not locked and is able to be steered or dynamically, freely pivot relative to the frame, the user may be able to more efficiently pivot or steer the shovel blade between two different angular orientations (e.g., right-to-left, left-to-right, left-to-center, right-to-center, vice versa, etc.) relative to frame, without having to stop to unlock the blade, reposition the blade, and relock the blade, thus saving time and making for a more efficient snow removal process. In some embodiments, the user is able to pivot or swivel the shovel blade while maintaining substantial contact of the leading edge of the shovel blade and the ground.

In some embodiments, a wheeled shovel includes a generally T-shaped handle at (e.g., attached, integrally formed, etc.) the upper portion of the frame. With the T-shaped handle, the user may rotate or lean the handle about the longitudinal axis, to cause or force the blade to pivot or swivel while maintaining forward motion of the wheeled shovel. In some embodiments, the T-shaped handle may also include grips (e.g., foam grips, etc.) for user comfort. The T-shaped handle may help the user resist torsional forces on the handle created by uneven forces on the shovel blade. This also helps the user maintain the shovel blade's pivoted angle relative to the frame without a separate locking mechanism. Alternative embodiments may include a handle with a different shape or geometry.

In those embodiments in which the device includes at least one wheel (e.g., a wheeled shovel with a single wheel, etc.), the inventor hereof has found that the wheel may be advantageous. For example, the inventor has found that for those embodiments of a wheeled shovel having a single wheel, the single wheel counteracts the side loads generated by pushing or plowing snow to one side or the other. Alternatively, some embodiments do not include any wheels and still operate satisfactorily depending, for example, on the application.

In some embodiments, a return spring (or other biasing device or means, resistance mechanism, etc.) may be added to return or bias the pivoted tool, such as the shovel blade or plow, back to the neutral, unpivoted configuration. In other embodiments, one or more detents or resistance mechanisms may be used for providing resistance for helping to temporarily hold the shovel blade in a position and angular orientation relative to the frame. The detent or resistance mechanism may thus inhibit the shovel blade from flopping about or pivoting when the shovel blade is being held in position by the detent or resistance mechanism. For example, a detent may be used for a wheeled shovel where the detent is engaged when the shovel blade is in the neutral, unpivoted, or straight-ahead position (i.e., not pivoted or swiveled to either the left or right side). The detent may be configured such that the detent automatically disengages or releases (thus allowing the shovel blade to pivot about the pivot axis relative to the frame) upon generation of a sufficient side force on the shovel blade, such as when the user tilts or twists the handle to one side or the other. As another example, a detent mechanism may include a spring plunger having a plunger/cylindrical rod and a spring biasing the plunger's end portion into interlocking engagement with a corresponding one of the grooves/recesses of the detent member. The detent mechanism may be disengaged and released by the user abruptly and forcefully leaning the frame to one side to cause the shovel blade to swivel or pivot with sufficient force for disengaging the detent mechanism from the corresponding recess. In some embodiments, the detent mechanism may be released by pulling on a second end portion of the plunger sufficiently hard enough to overcome the spring biasing force and move the plunger's first end portion away from the detent member to thereby disengage the plunger's first end portion from the corresponding recess/groove of the detent member, whereby disengagement allows the shovel blade to pivot or swivel freely relative to the wheeled shovel's frame.

A further embodiment may include one or more openings (e.g., holes, notches, etc.) each of which is associated with a corresponding pivotal position (e.g., neutral, unpivoted position, left position, right position, etc.) of the shovel blade relative to the frame. A ball may have an inner portion disposed within the frame and an outer portion that protrudes outwardly beyond an opening in the frame. A spring within the frame may be engaged with the inner portion of the ball for biasing the ball in a direction towards the openings associated with the shovel blade pivot. The engagement of the ball's outer portion within one of the one or more openings may thus inhibit pivotal movement of the shovel blade relative to the frame.

Any one or more aspects disclosed herein may be implemented individually or in any combination with any one or more of the other disclosed aspects.

FIGS. 1 through 7 illustrate an exemplary embodiment of a wheeled shovel 100 embodying one or more aspects of the present disclosure. As shown, the wheeled shovel 100 generally includes a frame, driving member, or longitudinal chassis member 104, a wheel 108, a handle 112, a shovel blade or plow 116, and a pivot or swivel 120. The pivot 120 couples the shovel blade 116 to the lower portion of the frame 104 such that the shovel blade 116 is steerable or pivotable relative to the frame 104 about a pivot axis (e.g., see pivot axis 224 in FIG. 9, etc.). As disclosed herein, the wheeled shovel 100 is configured such that the shovel blade 116 may be steered or dynamically pivoted (and remain in that pivoted position) about the pivot axis towards the left or right direction by a force applied to the shovel blade 116 that is generated as the wheeled shovel 100 is traveling in the forward direction with the frame 104 leaning to the same left or right direction. In some embodiments, the wheeled shovel 100 may be configured such that the shovel blade 116 has a range of pivotal motion of about one hundred twenty degrees with about sixty degrees of pivotal motion from a neutral, unpivoted position towards each of the left and right directions.

While FIGS. 1 through 7 illustrate a wheeled shovel 100 having a shovel blade 116, other embodiments may include a differently configured shovel blade or another type of tool (e.g., scraper, weeder, etc.) pivotably connected to a forward lower portion of the frame 104. In addition, some embodiments may include a second tool located behind the wheel 108, such as a cultivator, rake, weeder, etc. attached directly or indirectly to the frame 104. Accordingly, embodiments of the present disclosure should not be limited to use with only the shovel blade as shown in the figures. In addition, embodiments may also be used for other activities besides snow shoveling or plowing, such as removal, plowing, throwing, and/or transporting granular materials like gravel, soil, sand, coal, etc.

Figure 9:
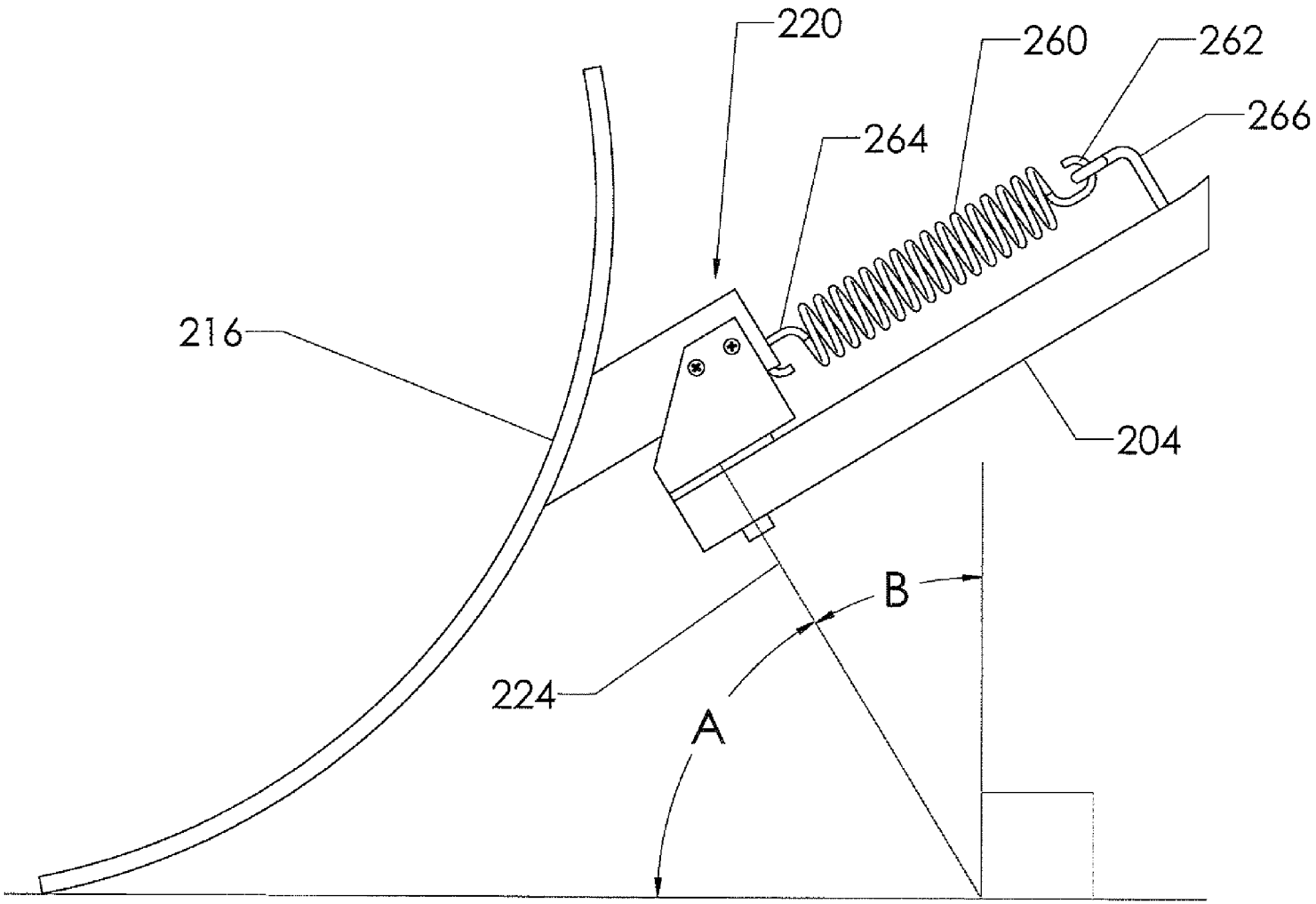
FIG. 9 is a partial side view of the wheeled shovel shown in FIG. 8 and illustrating the orientation of the pivot axis of the shovel blade relative to horizontal (angle A) and vertical (angle B) according to an exemplary embodiment.
Figure 10:
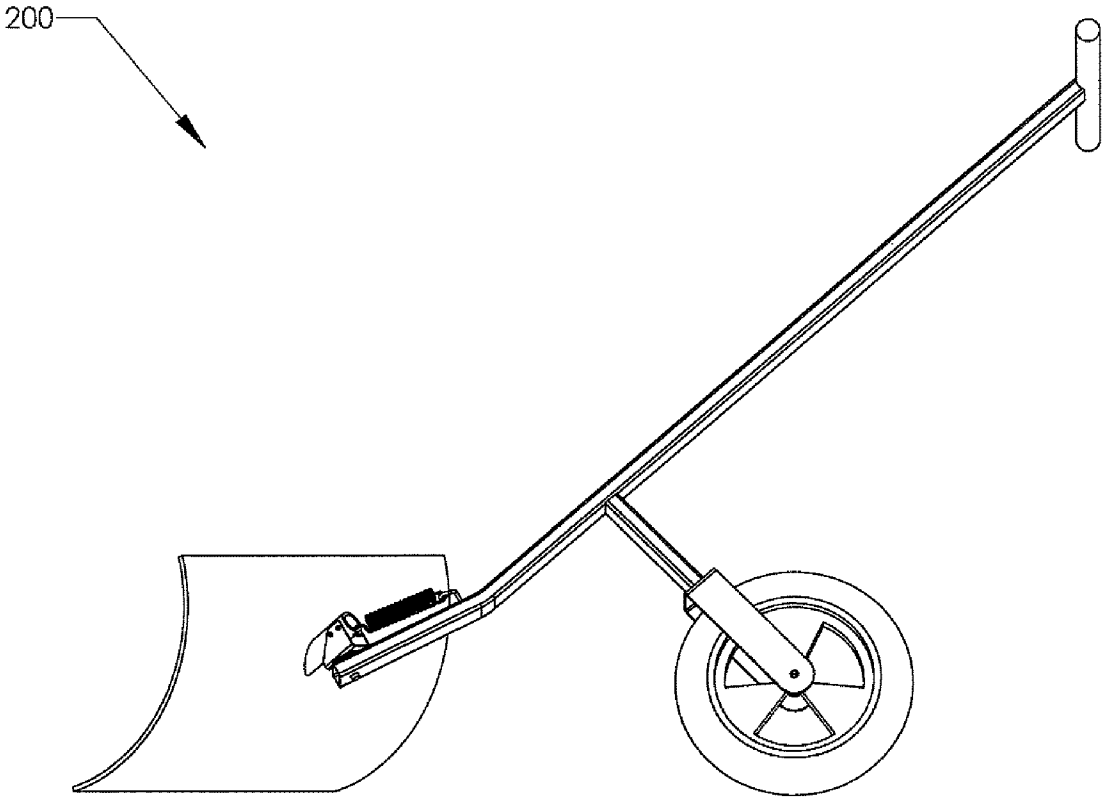
FIG. 10 is an upper perspective view of the wheeled shovel shown in FIG. 8 with the shovel blade pivoted/steered towards the right direction relative to the forward direction of travel of the wheeled shovel.

For the wheeled shovel 100, the pivot axis is not perpendicular to the intended forward direction of travel of the wheeled shovel 100 (e.g., see pivot axis 224 in FIG. 9, etc.). Instead the pivot axis is titled in a direction towards the forward direction of travel of the wheeled shovel 100. Also in this embodiment, the pivot axis is generally perpendicular to a longitudinal axis of the frame 204. The pivot axis forms an acute angle (e.g., about sixty degrees, etc.) with a surface supporting the wheeled shovel 100 relative to the front of the wheeled shovel 100. The orientation of the pivot axis allows the shovel blade 116 to remain pivoted towards the left or right direction without having to lock the shovel blade 116 in place, as the wheeled shovel 100 is traveling in the forward direction with the frame 104 leaning to the same left or right direction. The shovel blade 116 remains pivoted by virtue of a force applied to the shovel blade 116 that is generated as the wheeled shovel 100 is traveling in the forward direction with the frame 104 leaning to the same left or right direction. Accordingly, the wheeled shovel 100 does not include a separate locking mechanism for maintaining the shovel blade 116 pivoted towards the left or right direction. Alternative embodiments, however, may include such a locking mechanism.

Figure 4:
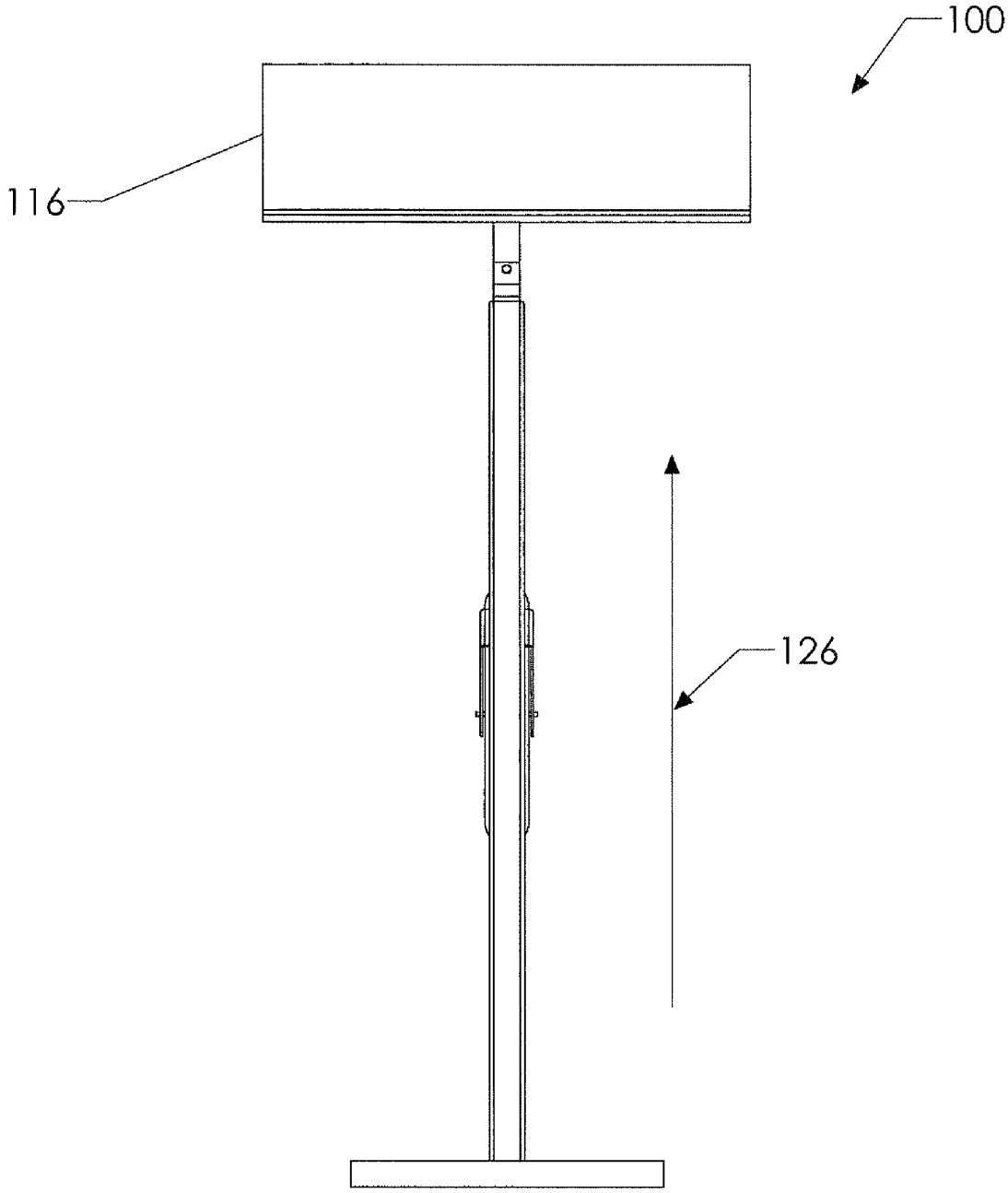
FIG. 4 is an upper view of the wheeled shovel shown in FIG. 1 with the shovel blade in a neutral, unpivoted position in which the shovel blade is generally aligned with the forward direction of travel of the wheeled shovel.
Figure 5:
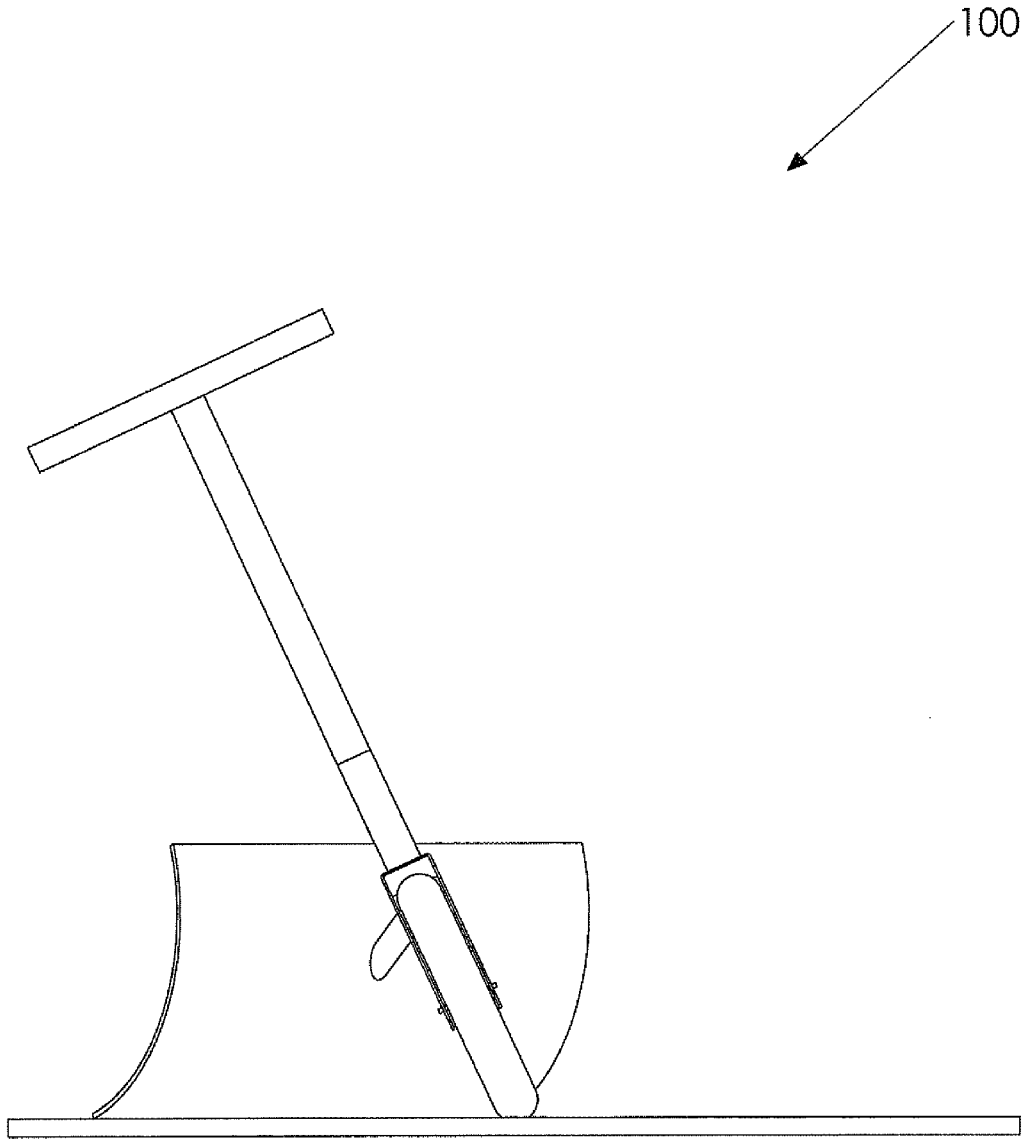
FIG. 5 is a rear view of the wheeled shovel shown in FIG. 2 with the shovel blade pivoted/steered towards the left direction.
Figure 6:
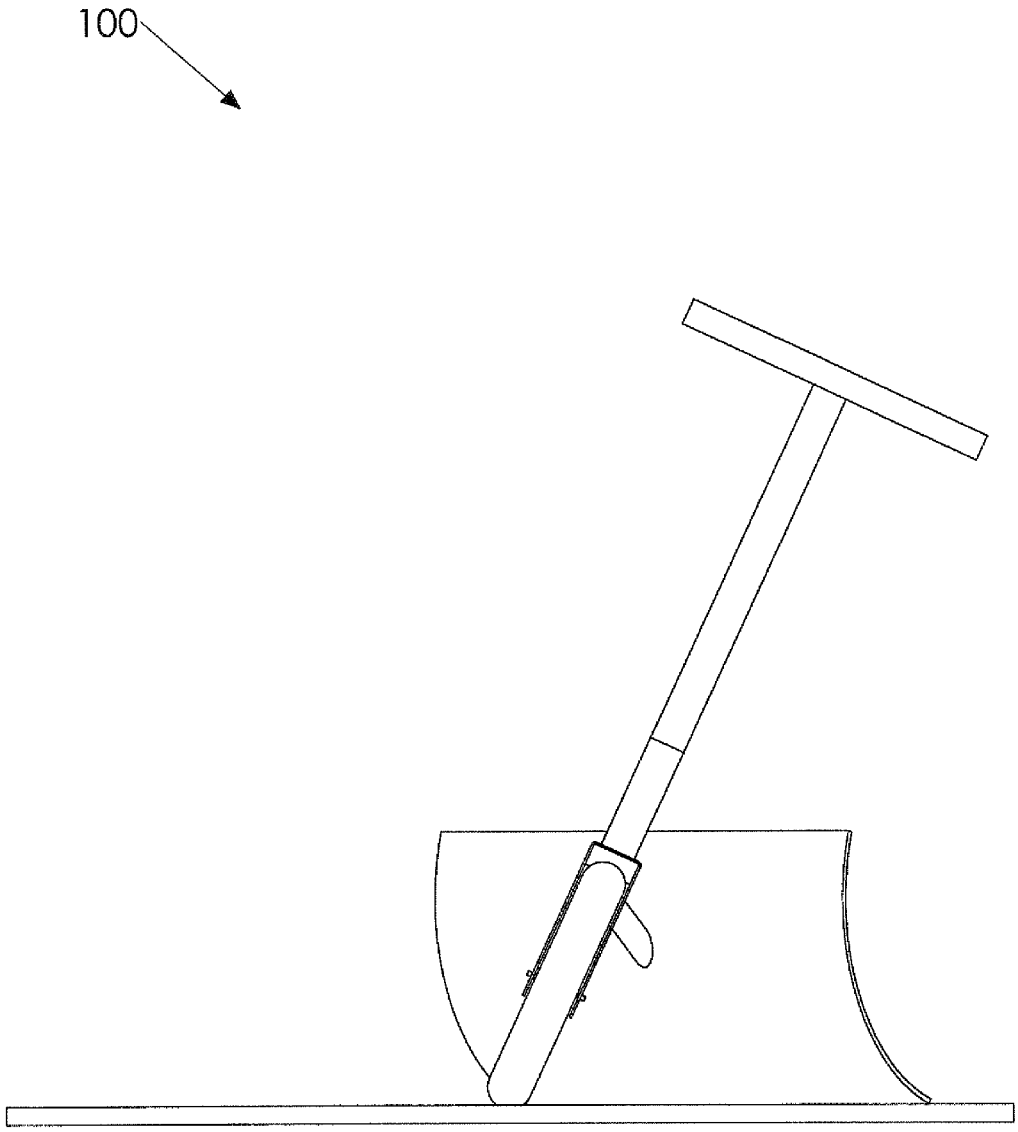
FIG. 6 is a rear view of the wheeled shovel shown in FIG. 3 with the shovel blade pivoted/steered towards the right direction.
Figure 7:
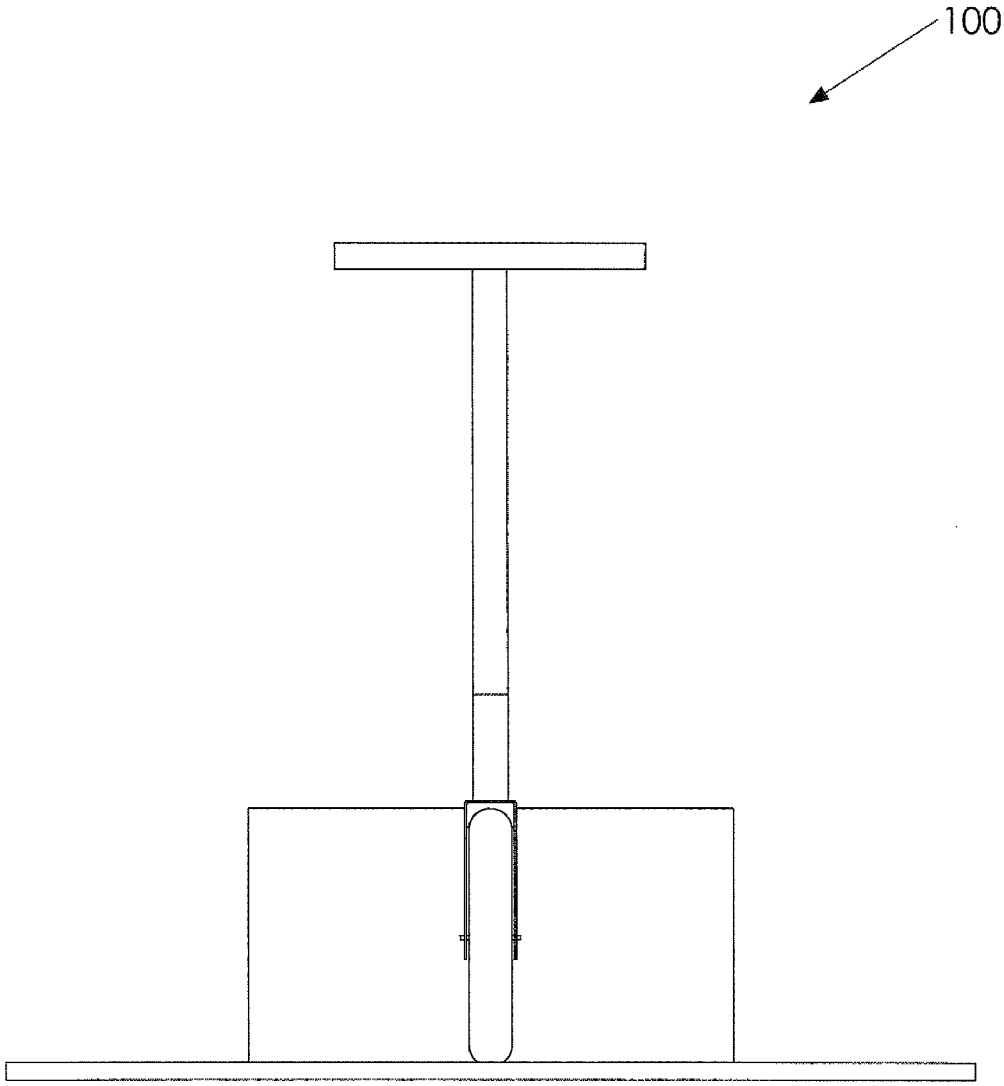
FIG. 7 is a rear view of the wheeled shovel shown in FIG. 4 with the shovel blade in the neutral, unpivoted position.
Figure 8:
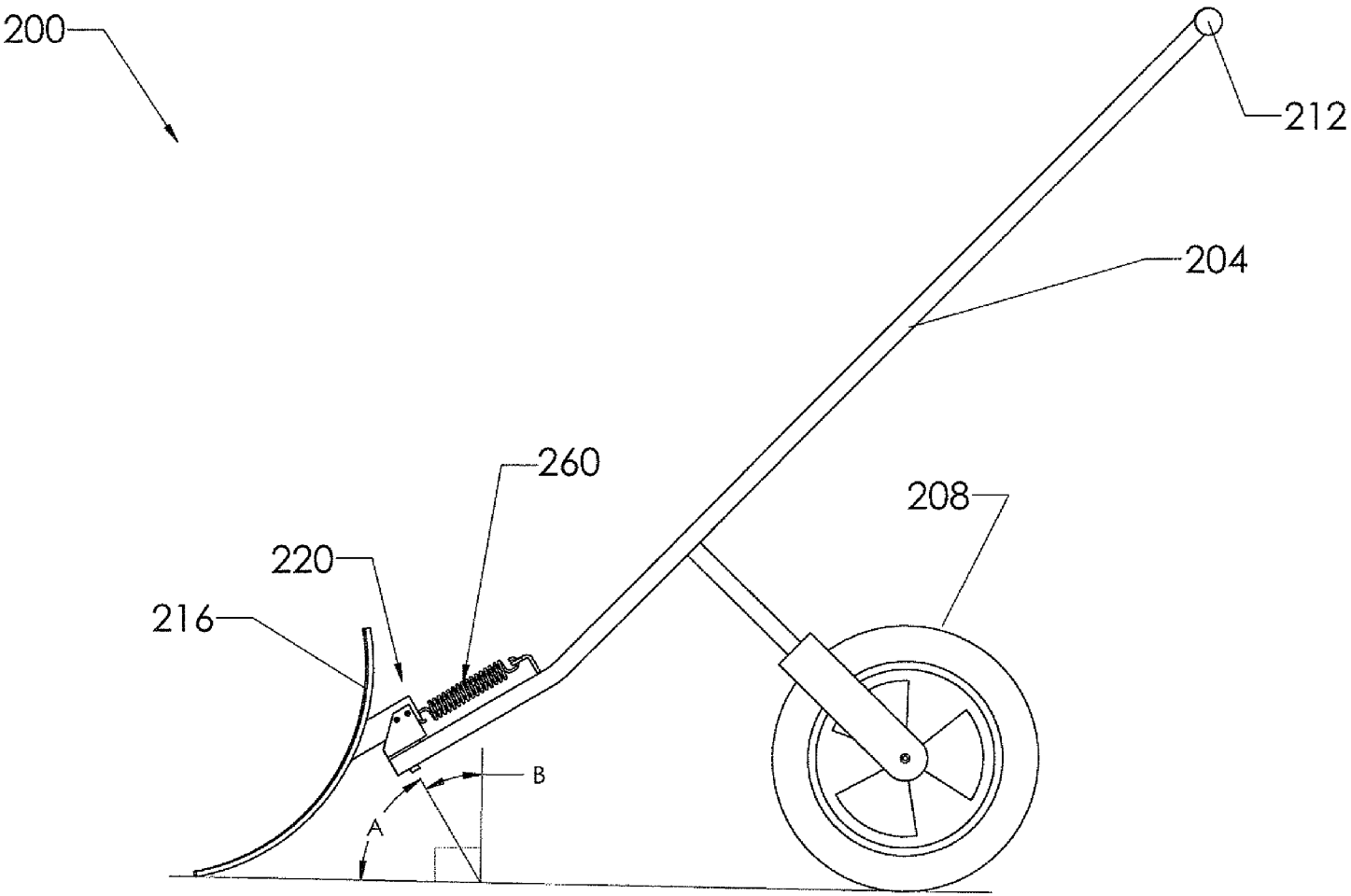
FIG. 8 is a side view of another exemplary embodiment of a wheeled shovel having a frame, a pivotable/steerable shovel blade, a swivel pivotably coupling the shovel blade to the frame, and a return spring for applying a spring biasing force for biasing the shovel blade into a neutral, unpivoted position.

The frame 104 may be formed from a wide variety of materials (e.g., continuous metal tubing, etc.) in a wide variety of configurations. In this particular embodiment, the frame 104 includes a generally straight elongate member 134 that is generally slanted relative to the forward direction of travel of the wheeled shovel 100. The wheeled shovel 100 further includes a member 135 having a first end portion 136 coupled to (e.g., attached, integrally formed with, etc.) the frame 104 and a second end portion 138 coupled to the wheel 108. The wheel 108 is closer to the front of the frame 104 than the rear of the frame 104. The wheel 108 is also generally centered directly underneath the generally straight elongate member 134, as shown by FIG. 4. Alternative embodiments may include differently configured frames and/or different mounting methods for the wheel 108. For example, some embodiments may include a wheel that is coupled directly to the frame without any intermediate components, such as member 135.

In this illustrated embodiment, the wheeled shovel 100 includes a single wheel 108. Alternative embodiments may include more than one wheel, such as the two-wheeled embodiment shown in FIGS. 18 and 19. In addition, the wheel 108 may be relatively small or relatively large. Plus, different types of wheels may be used, including wheels with spokes, air-inflatable tubes, tubeless air-inflatable tires, treaded tires, etc. Further, any number of different ways may be employed to attach the wheel 108, such as quick release for bicycle wheels or screw-on knobs.

A wide range of devices may be used to couple the shovel blade 116 to the frame 104. In one exemplary embodiment, the pivot 120 comprises pins engageably received within holes. In another exemplary embodiment, the pivot 120 comprises a swivel of a caster. Alternative devices may be used to pivotably attach the shovel blade to the frame.

The wheeled shovel 100 may be configured such that the shovel blade 116 is pivotable about the pivot axis while the wheel 108 and a bottom surface portion (e.g., lower surface of the shovel blade leading edge, etc.) of the shovel blade 116 maintain substantial contact with a surface supporting the wheeled shovel 100.

The handle 112 may be preferably configured to facilitate the user in tilting or twisting the handle 112 for leaning the frame 104. In the illustrated embodiment, the handle 112 is generally T-shaped. The handle 112 includes a cross-bar 140 having right and left end portions 142, 144 extending outwardly beyond the frame 104 in the respective right and left directions. The handle 112 may be separately attached to the frame 104, for example, with mechanical fasteners. Or, for example, the handle 112 may be integrally formed with the handle 112.

The shovel blade 116 may be made from a wide range of materials. For example, the shovel blade 116 may be made from polyester, nylon, polyethylene, etc.

Figure 1:
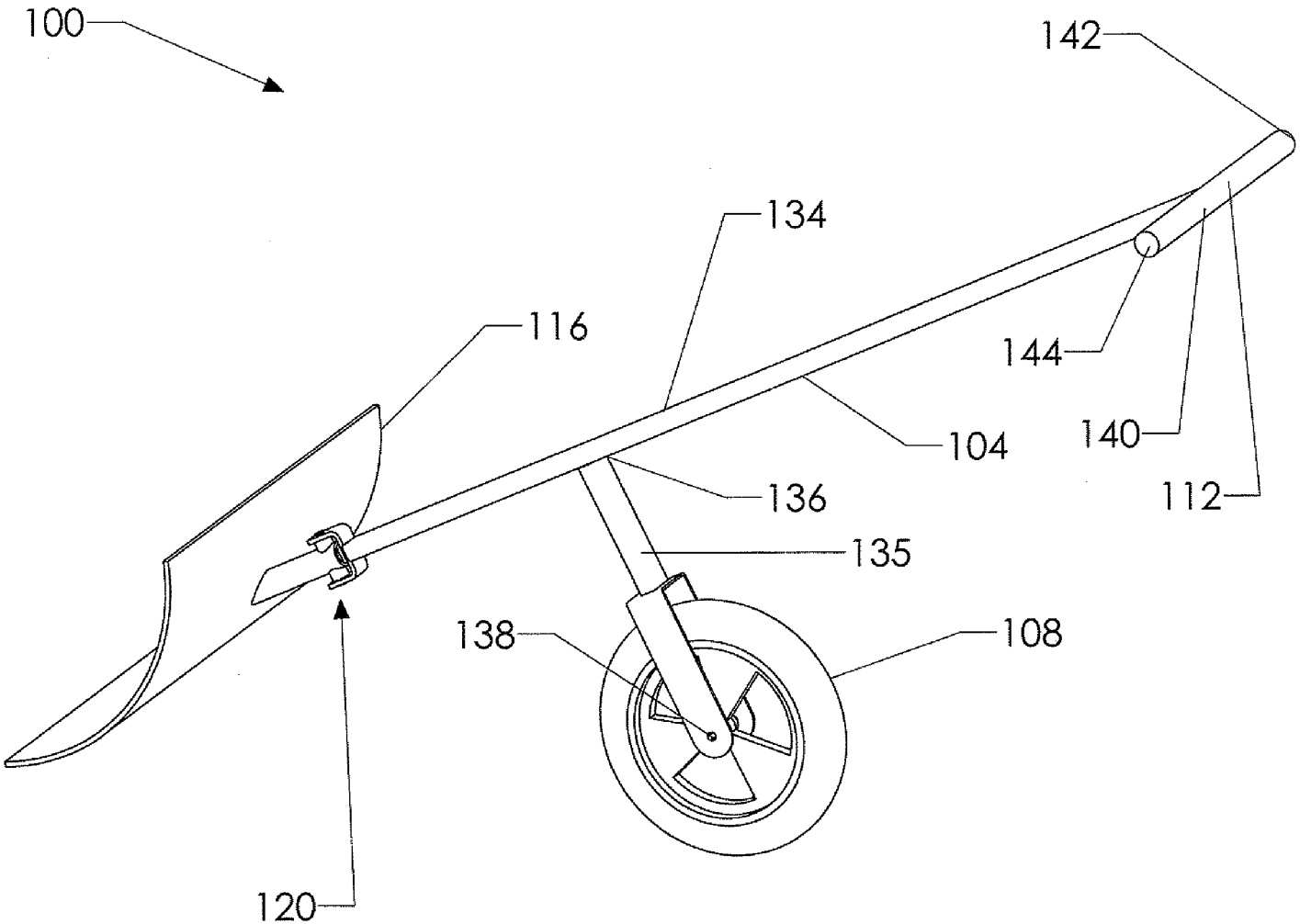
FIG. 1 is a perspective view of a wheeled shovel having a frame, a pivotable/steerable shovel blade, and a swivel pivotably coupling the shovel blade to the frame according to an exemplary embodiment.
Figure 2:
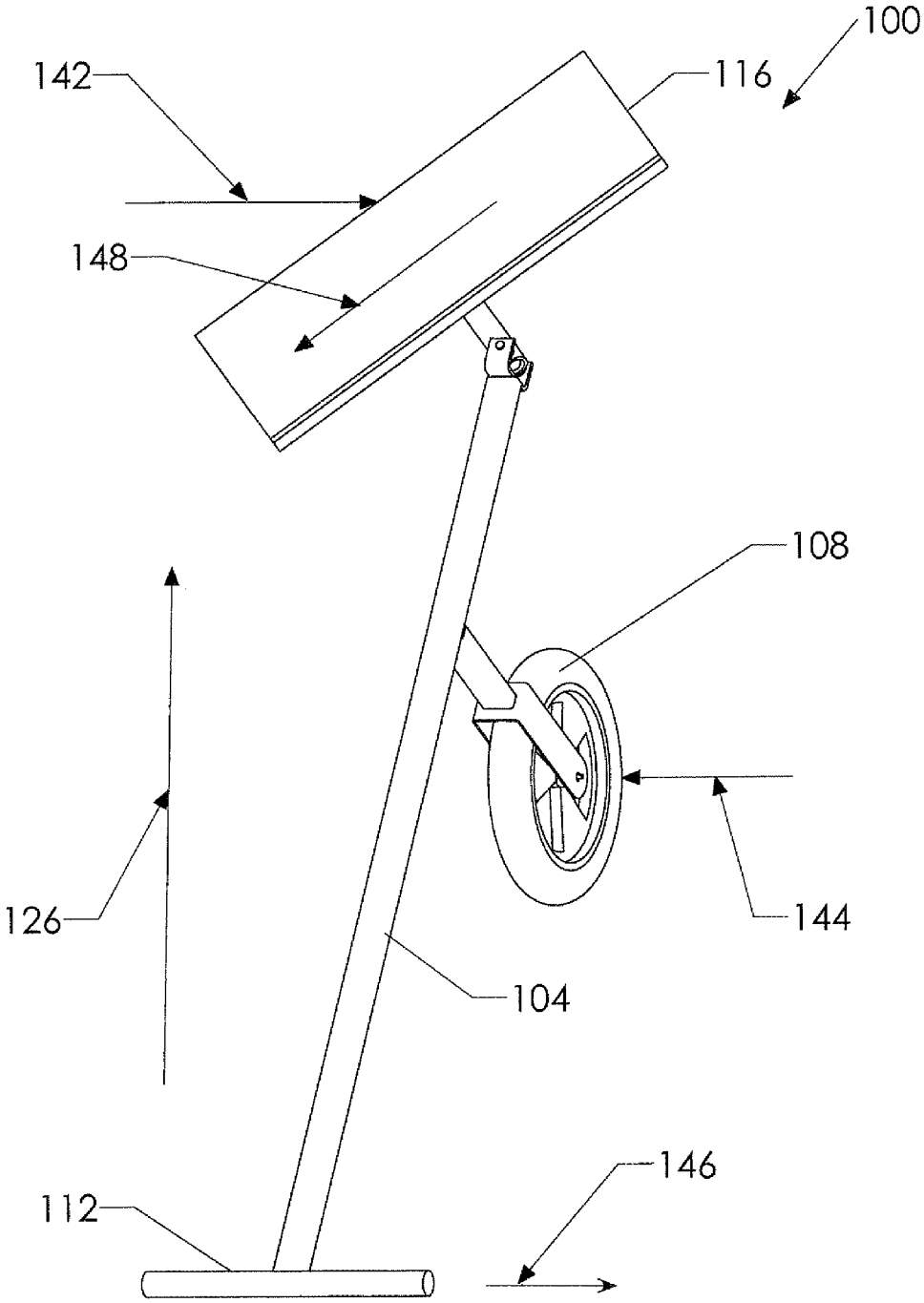
FIG. 2 is an upper perspective view of the wheeled shovel shown in FIG. 1, and illustrating force component vectors acting upon the wheeled shovel when the shovel blade is pivoted/steered towards the left direction, the wheeled shovel is moving in the forward direction, and the frame is leaning towards the right direction.

FIG. 2 illustrates the force component vectors 142, 144, 146 that may act upon the wheeled shovel 100 when the shovel blade 116 is pivoted towards the left direction and the wheeled shovel 100 is moving in the forward direction (as represented by arrow 126) with the frame 104 leaning towards the left direction. As shown in FIG. 2, there is a side force 142 acting upon the shovel blade 116. There is also a side force 144 acting upon the wheel 108 in a generally opposite direction as the side force 142 acting upon the shovel blade 116. Accordingly, the single wheel 108 helps counteract the side force 142 that is generated while using the wheeled shovel 100 to push or plow snow in the direction generally indicated by arrow 148. Also shown in FIG. 1, the arrow 146 represents the user via the handle 112 countering or resisting the torsional force generated by the tendency of the shovel blade 116 to pivot back towards the neutral, unpivoted position.

Figure 3:
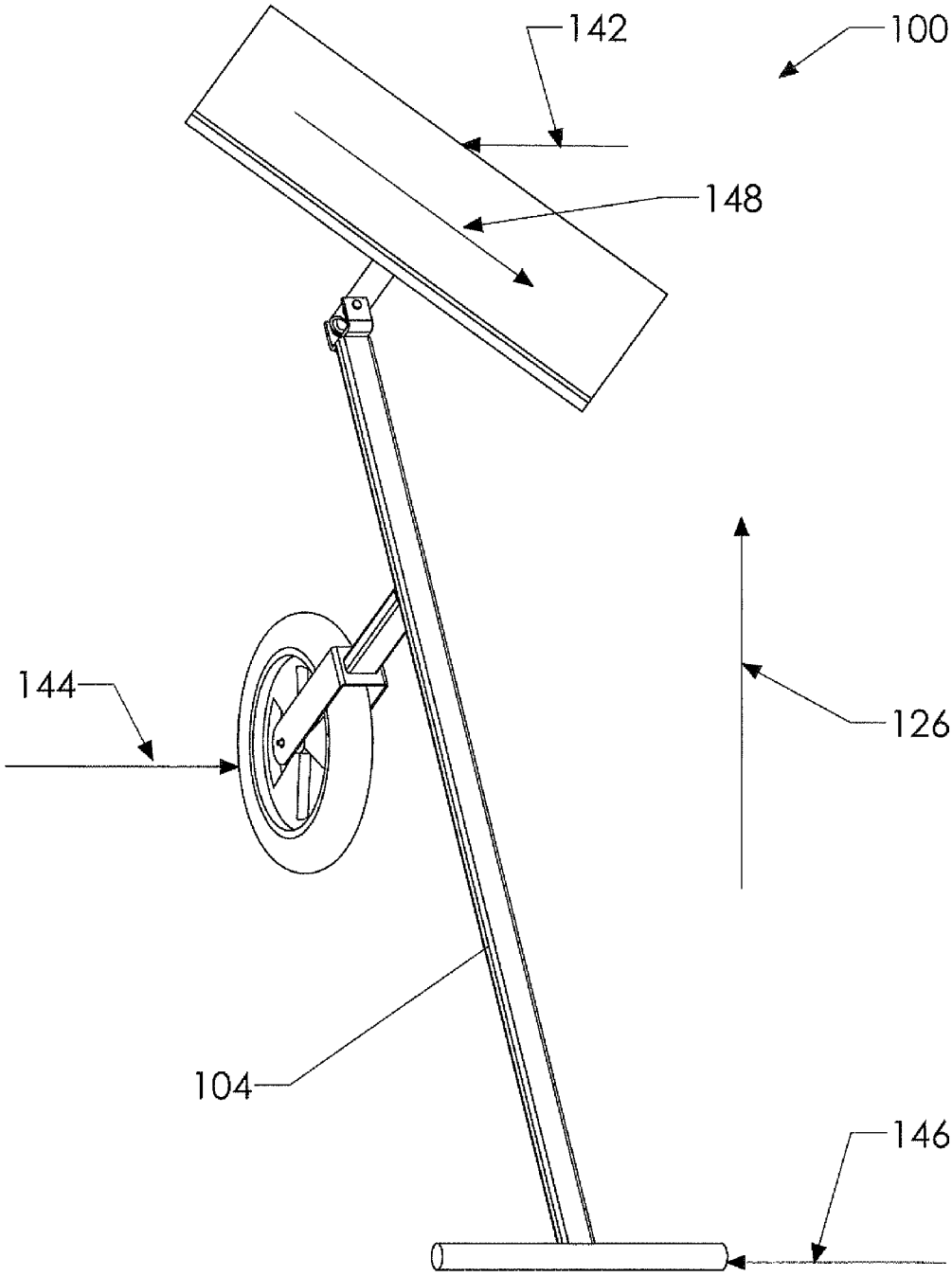
FIG. 3 is an upper perspective view of the wheeled shovel shown in FIG. 1, and illustrating force component vectors acting upon the wheeled shovel when the shovel blade is pivoted/steered towards the right direction, the wheeled shovel is moving in the forward direction, and the frame is leaning towards the left direction.

FIG. 3 illustrates the wheeled shovel 100 with the shovel blade 116 now pivoted towards the opposite direction. As compared to FIG. 2, the shovel blade 116 has been pivoted from the left direction (FIG. 2) to the right direction (FIG. 3). Again, the wheeled shovel 100 is moving in a forward direction (as represented by arrow 126 in FIG. 3), but now the frame 104 is leaning towards the opposite direction as compared to what is shown in FIG. 2 for example, to push or plow snow in the direction generally indicated by arrow 148. In this configuration, the force component vectors 142,144,146 acting on the wheeled shovel 100 are in directions generally opposite what is shown in FIG. 2.

FIG. 4 illustrates the wheeled shovel 100 with the shovel blade 116 in a neutral, unpivoted position. In this position, the shovel blade 116 is generally aligned with a forward direction 126 of travel of the wheeled shovel 100. In some embodiments, a centerline axis of the shovel blade 116 may be aligned with a centerline axis of the frame 104 when the shovel blade 116 is in the neutral, unpivoted position.

FIGS. 8 through 11 illustrate another exemplary embodiment of a wheeled shovel 200 embodying one or more aspects of the present disclosure. As shown, the wheeled shovel 200 generally includes a frame, driving member, or longitudinal chassis member 204, a wheel 208, a handle 212, a shovel blade or plow 216, and a pivot or swivel 220. The pivot 220 couples the shovel blade 216 to the frame 204 such that he shovel blade 216 is pivotable about a pivot axis 224 (FIG. 9). The wheeled shovel 200 may be configured such that the shovel blade 216 may be steered or dynamically pivoted (and remain in that pivoted position) about the pivot axis 224 towards the left or right direction by a force applied to the shovel blade 216 that is generated as the wheeled shovel 200 is traveling in the forward direction with the frame 204 leaning to the same left or right direction.

As shown by angle B in FIG. 9, the pivot axis 224 is non-vertical and is tilted or angled forward of vertical. In addition, the pivot axis 224 is also not perpendicular to a horizontal surface when the wheeled shovel 200 is supported on a horizontal surface. Instead, the pivot axis 224 is generally slanted forward and forms an acute angle A (e.g., about sixty degrees, etc.) with the horizontal surface (e.g., sidewalk, driveway, road, walkway, or other surface from which snow is being removed, etc.).

In this particular embodiment, the wheeled shovel 200 also includes means for biasing the shovel blade 216 towards a neutral, unpivoted position relative to the frame 204 in the form of a return spring 260. The return spring 260 has a first end portion 262 coupled to the frame 204 and a second end portion 264 coupled to the shovel blade 204. As the shovel blade 216 pivots about the pivot axis 224, the return spring 260 is extended, which, in turn, generates a spring biasing force that biases the shovel blade 216 into the neutral, unpivoted position. Alternative embodiments may include other means and devices (e.g., other springs, resilient rubber members, etc.) for biasing the shovel blade towards a neutral, unpivoted position.

Figure 11:
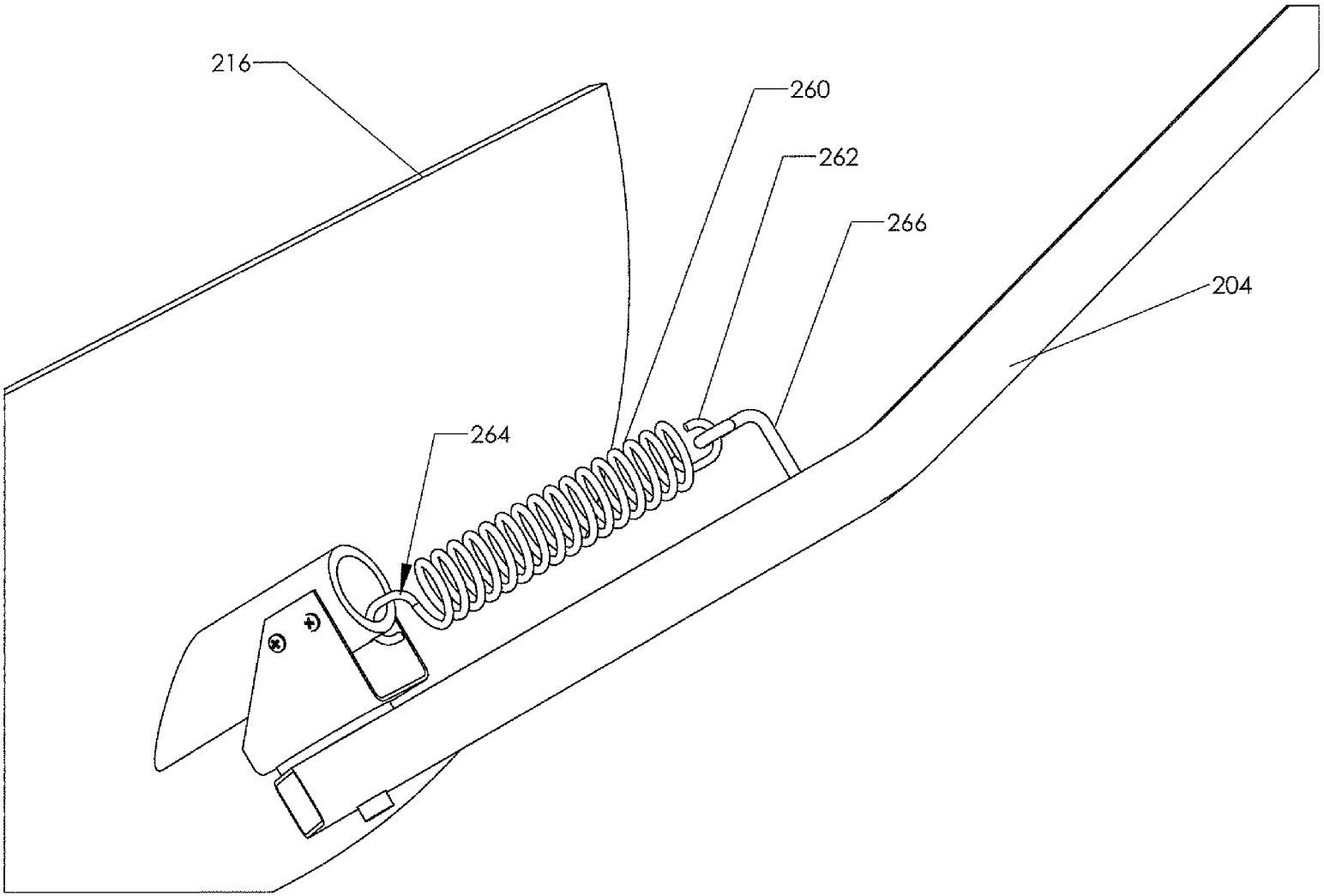
FIG. 11 is a partial perspective view of the return spring and swivel pivotably connecting the shovel blade to the frame of the wheeled shovel shown in FIG. 8.

With continued reference to FIGS. 9 and 11, the first end portion 262 of the return spring 260 is hooked and coupled to an eye bolt connector 266, which, in turn, is bolted to the frame 204. The second end portion 264 of the return spring 260 is hooked and coupled to a hole. Alternative embodiments may include other attachment means and coupling methods for the return spring.

Other than the return spring 260, one or more of the other components (e.g., 204, 208, 212, 216, 220, 224, etc.) of the wheeled shovel 200 may be configured similar to the corresponding other components of the wheeled shovel 100 in at least some embodiments thereof.

Figure 12:
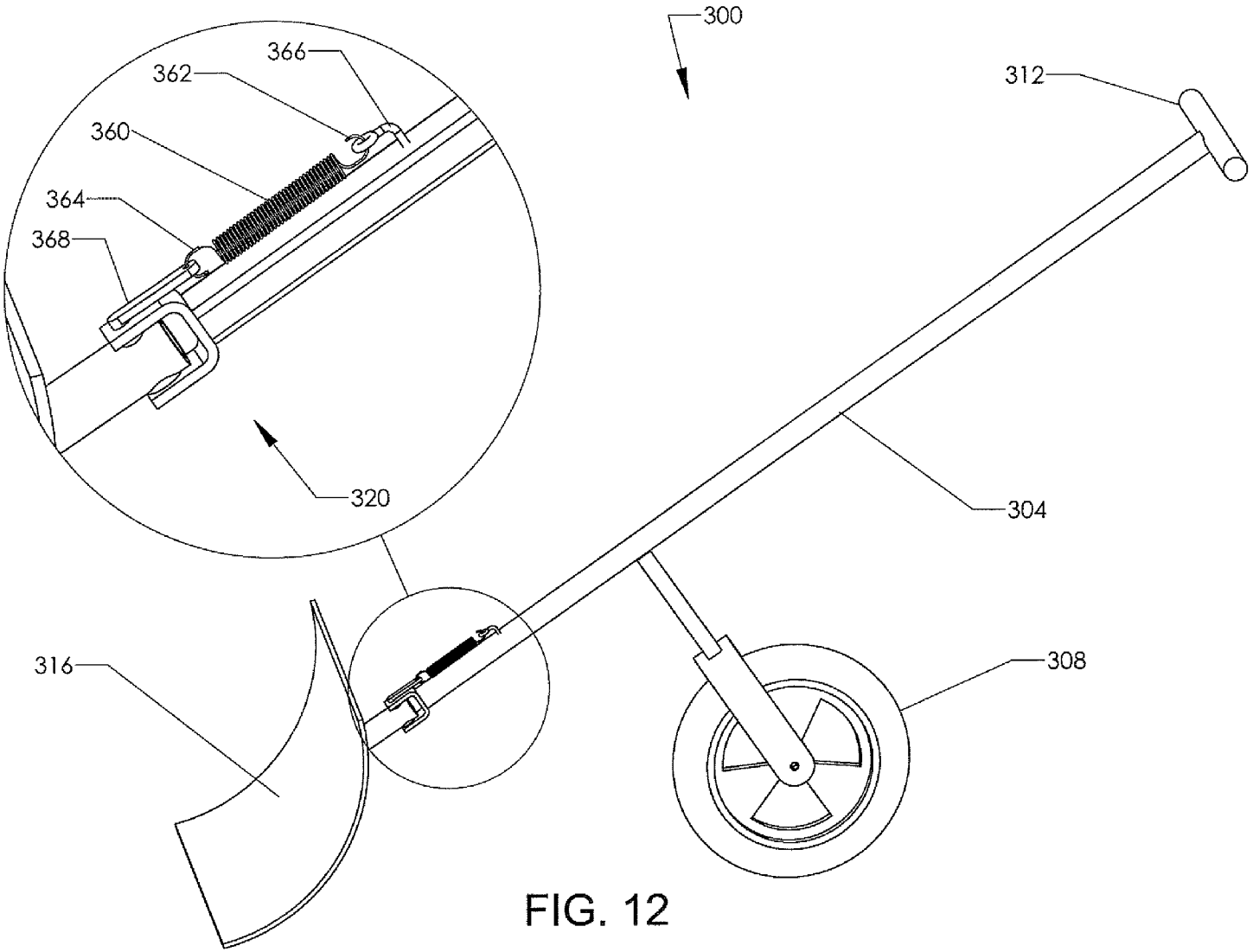
FIG. 12 is an upper perspective view of another exemplary embodiment of a wheeled shovel having a frame, a shovel blade, a swivel pivotably coupling the shovel blade to the frame, and a return spring for biasing the shovel blade towards the neutral, unpivoted position in which the shovel blade is generally aligned with a forward direction of travel of the wheeled shovel.
Figure 13:
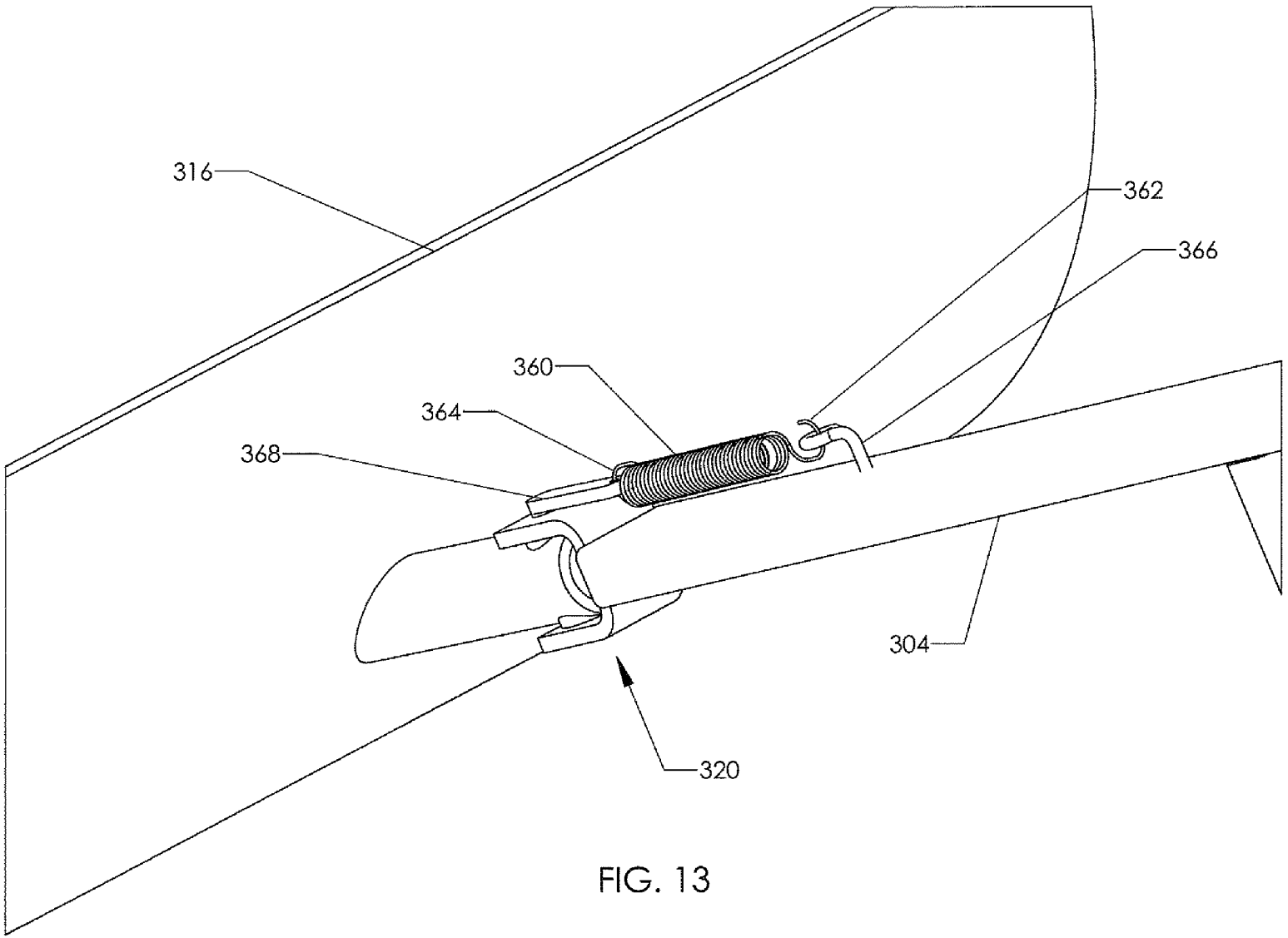
FIG. 13 is a partial view of the return spring and swivel pivotably connecting the shovel blade to the frame of the wheeled shovel shown in FIG. 12.

FIGS. 12 and 13 illustrate another exemplary embodiment of a wheeled shovel 300 embodying one or more aspects of the present disclosure. As shown, the wheeled shovel 300 generally includes a frame, driving member, or longitudinal chassis member 304, a wheel 308, a handle 312, a shovel blade or plow 316, and a pivot or swivel 320. The pivot 320 couples the shovel blade 316 to the frame 304 such that he shovel blade 316 is steerable or pivotable about a pivot axis. The wheeled shovel 300 may be configured such that the shovel blade 316 may be steered or dynamically pivoted (and remain in that pivoted position) about the pivot axis towards the left or right direction by a force applied to the shovel blade 316 that is generated as the wheeled shovel 300 is traveling in the forward direction with the frame 304 leaning to the same left or right direction.

In this particular embodiment, the wheeled shovel 300 also includes means for biasing the shovel blade 316 into a neutral, unpivoted position relative to the frame 304 in the form of a return spring 360. The return spring 360 has a first end portion 362 coupled to the frame 304 and a second end portion 364 coupled indirectly to the shovel blade 304. As the shovel blade 316 pivots about the pivot axis, the return spring 360 is extended, which, in turn, generates a spring biasing force that biases the shovel blade 316 towards the neutral, unpivoted position. Alternative embodiments may include other means and devices (e.g., other springs, resilient rubber members, etc.) for biasing the shovel blade towards a neutral, unpivoted position.

With reference to FIG. 13, the first end portion 362 of the return spring 360 is hooked and coupled to an eye bolt connector 366, which, in turn, is bolted to the frame 304. The second end portion 364 of the return spring 360 is hooked and coupled to a link 368. The link 368 may be an integral part of the shovel blade 316 or be attached to the shovel blade 316. Alternative embodiments may include other attachment means and coupling methods for the return spring.

Other than the return spring 360, one or more of the other components (e.g., 304, 308, 312, 316, 320, etc.) of the wheeled shovel 300 may be configured similar to the corresponding other components of the wheeled shovel 100 in at least some embodiments thereof.

FIGS. 14 through 17 illustrate another exemplary embodiment of a wheeled shovel 400 embodying one or more aspects of the present disclosure. As shown, the wheeled shovel 400 generally includes a frame, driving member, or longitudinal chassis member 404, a wheel 408, a handle 412, a shovel blade or plow 416, and a pivot or swivel 420. The pivot 420 couples the shovel blade 416 to the frame 404 such that the shovel blade 416 is pivotable about a pivot axis. The wheeled shovel 400 may be configured such that the shovel blade 416 may be dynamically pivoted (and remain in that pivoted position) about the pivot axis towards the left or right direction by a force applied to the shovel blade 416 that is generated as the wheeled shovel 400 is traveling in the forward direction with the frame 404 leaning to the same left or right direction.

In this particular embodiment, the wheeled shovel 400 also includes a spring plunger 472 coupled to the frame 404 and a member 474 coupled to the shovel blade 416. The member 474 includes a plurality of grooves or recesses 476. In other embodiments, the spring plunger 472 may be coupled to the shovel blade 416, and the member 474 may be coupled to the frame 404.

Figure 14:
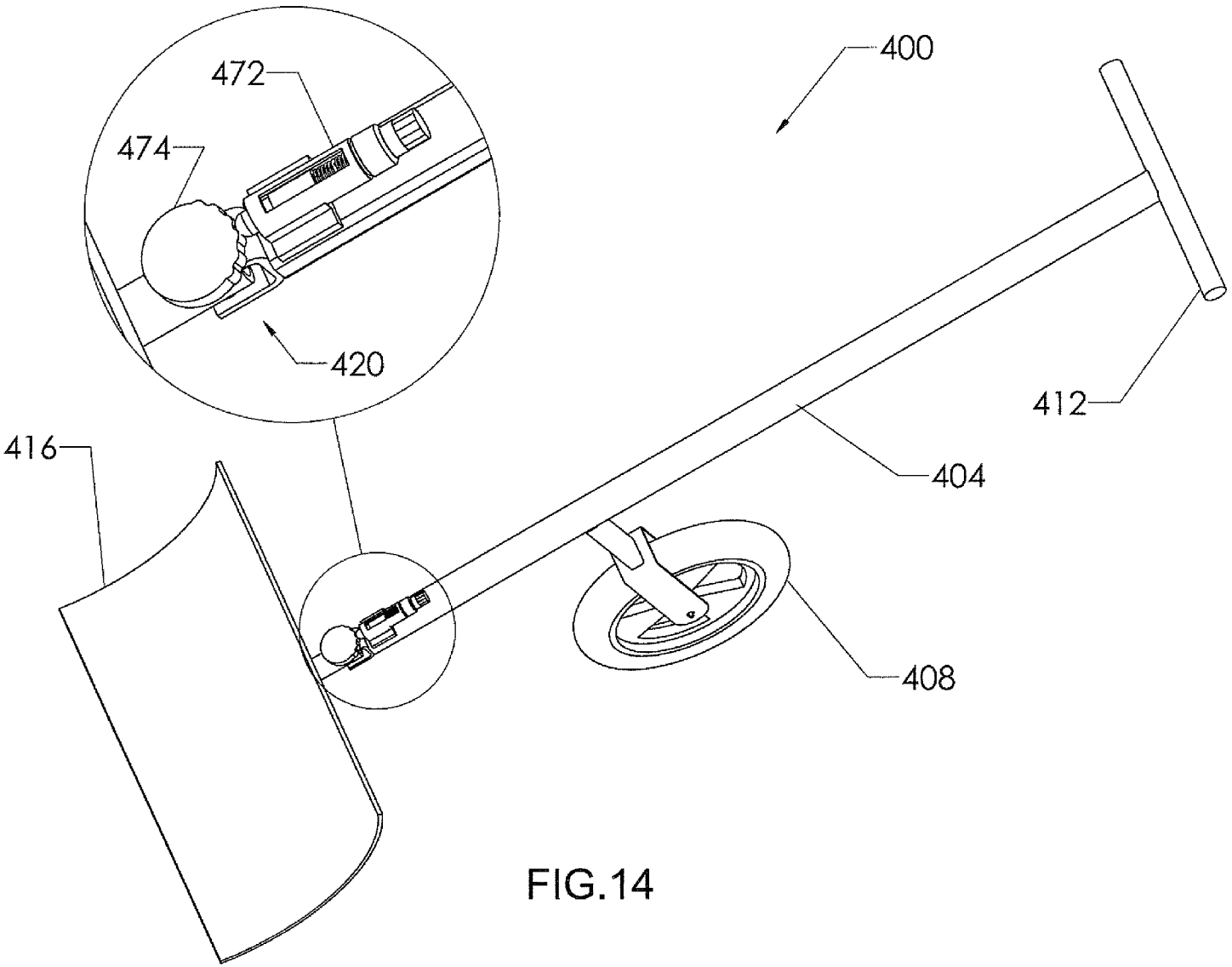
FIG. 14 is an upper perspective view of another exemplary embodiment of a wheeled shovel having a frame, a pivotable/steerable shovel blade, a swivel pivotably coupling the shovel blade to the frame, and a detent mechanism that may be used for temporarily holding the shovel blade in a position relative to the frame.
Figure 15:
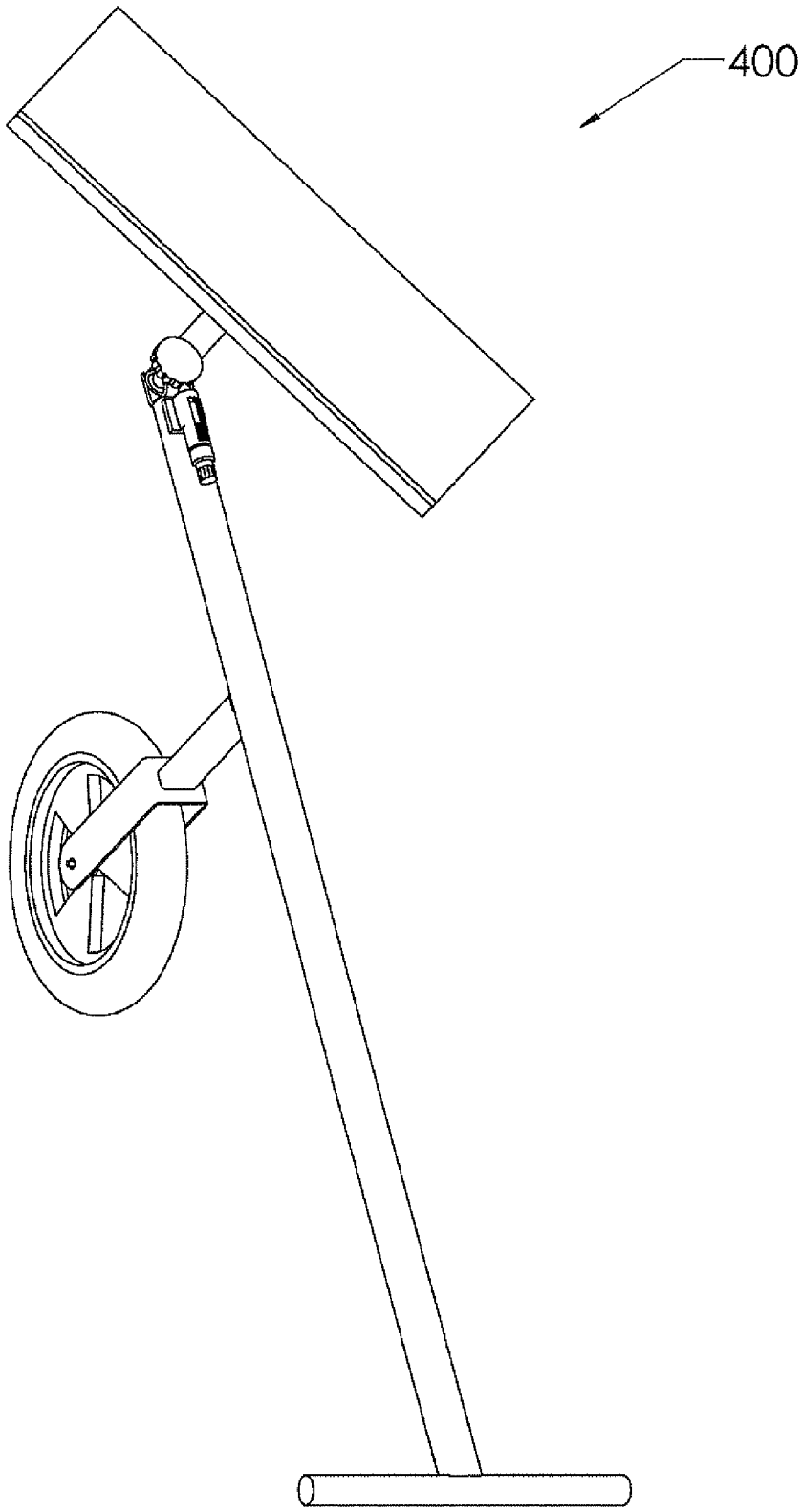
FIG. 15 is an upper partial view of the detent mechanism of the wheeled shovel shown in FIG. 14, and also illustrating the detent mechanism helping retain the shovel blade pivoted or steered to the right relative to the forward direction of travel of the wheeled shovel.
Figure 16:
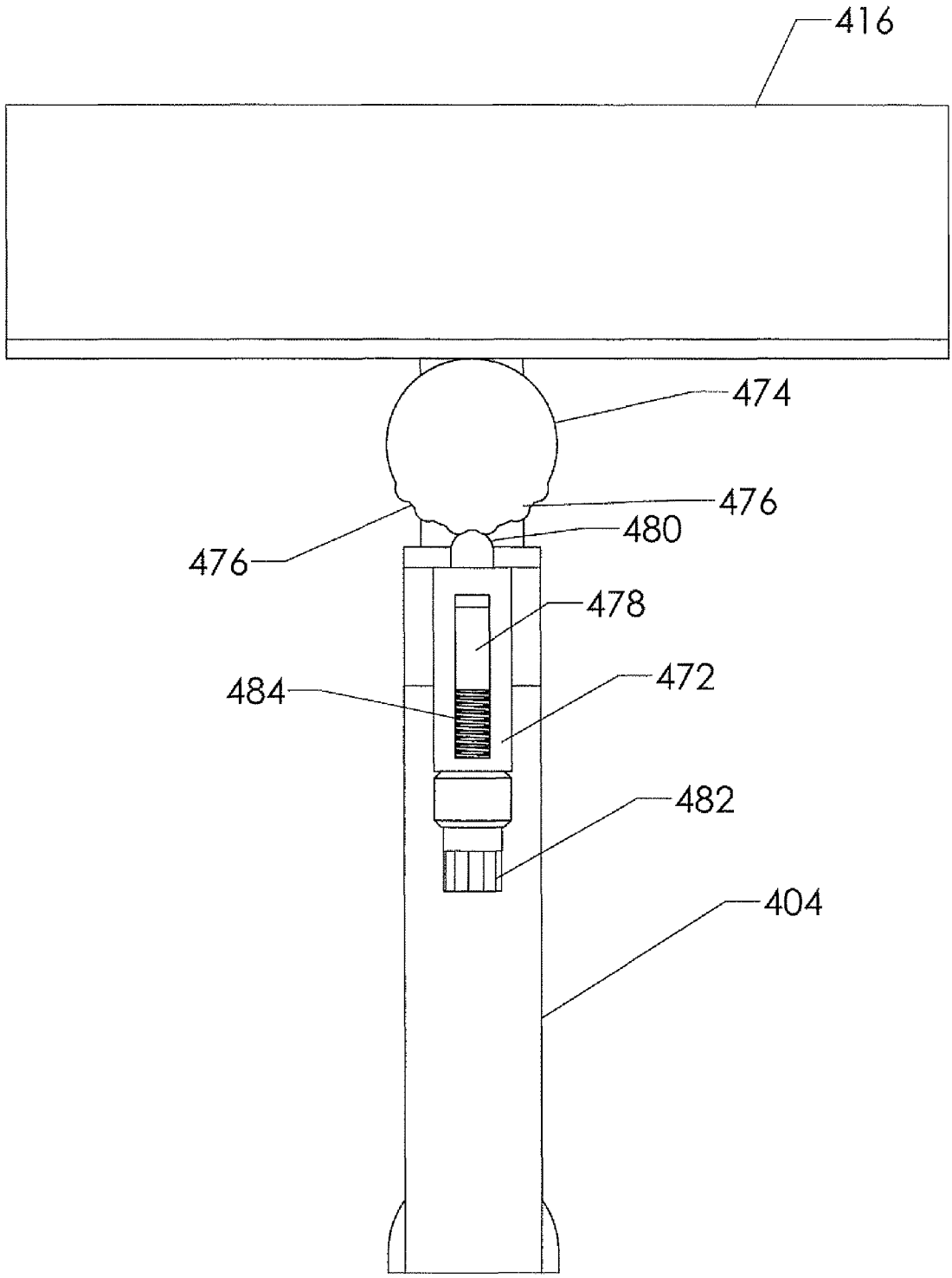
FIG. 16 is an upper partial view of the detent mechanism of the wheeled shovel shown in FIG. 14, and also illustrating the detent mechanism helping retain the shovel blade in a neutral, unpivoted position in which the shovel blade is generally aligned with the forward direction of travel of the wheeled shovel.
Figure 17:
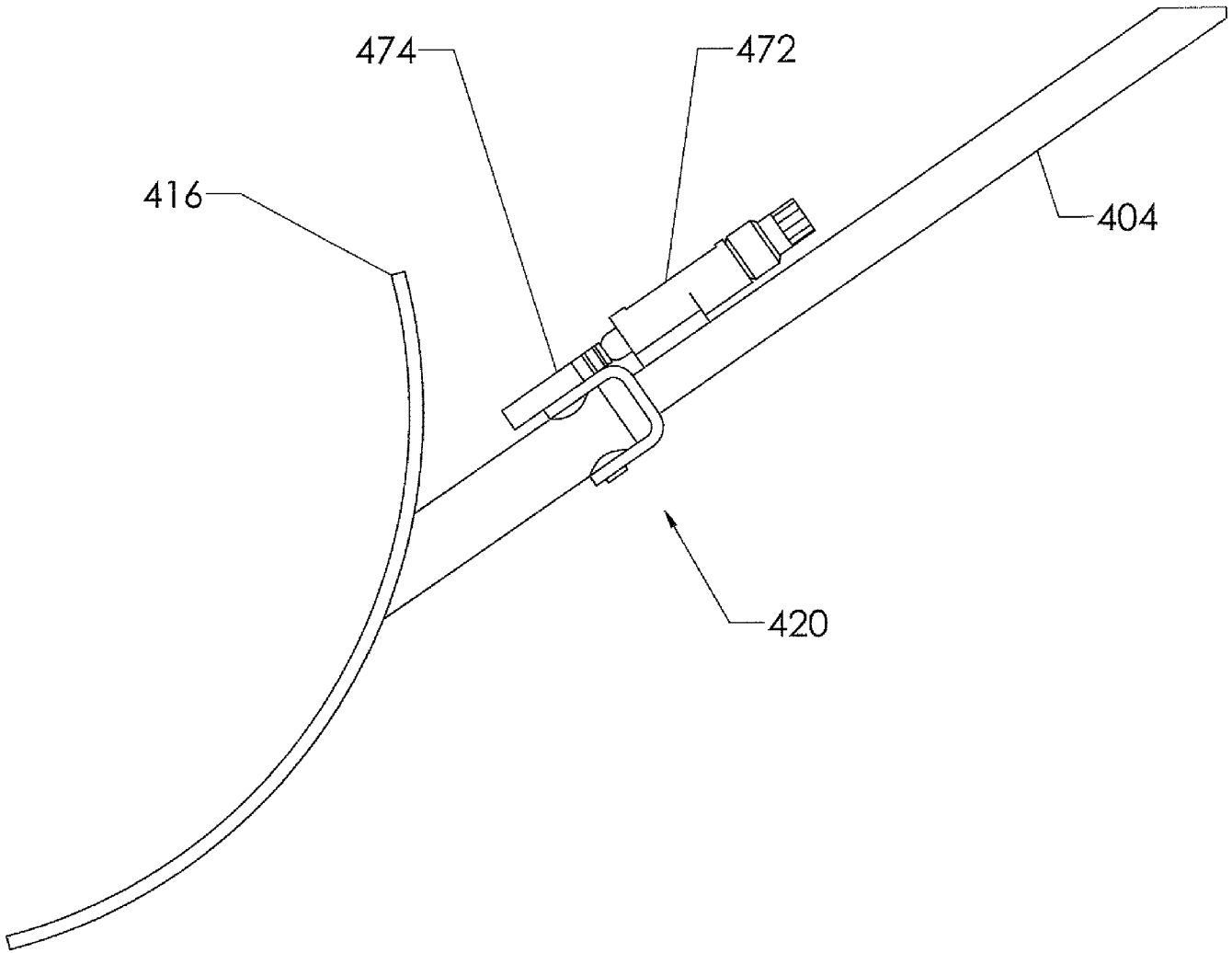
FIG. 17 is a side view of the detent mechanism and swivel pivotably connecting the shovel blade to the frame of the wheeled shovel shown in FIG. 14.

As shown in FIG. 16, the spring plunger 472 includes a plunger 478 having first and second end portions 480 and 482. A spring 484 applies a spring biasing force for biasing the plunger's first end portion 480 into engagement with one of the recesses 476. The engagement of the plunger's first end portion 480 with the recess 476 helps retain the relative positioning of the shovel blade 416 to the frame 404. In FIG. 14, the plunger's first end portion 480 is shown engaged with a recess 476 that helps retain the shovel blade 416 in a neutral, unpivoted configuration. By way of comparison, FIG. 15 illustrates the plunger's first end portion 480 engaged with a different recess 476 that helps retain the shovel blade 416 pivoted towards the right direction. The spring plunger 472 may be configured such that the plunger's first end portion 480 automatically disengages from the recess 476 upon generation of a sufficient force on the shovel blade 416 for overcoming the spring biasing force. With the disengagement of the plunger's first end portion 480 from the recess 476, the shovel blade 416 may be pivotable about the pivot axis. Additionally, or alternatively, the spring plunger 472 may be configured such that the plunger's first end portion 480 may be manually disengaged from the recess 476 by pulling the plunger's second end portion 482 in a direction generally away from the recess 476 with sufficient force for overcoming the spring biasing force.

Other than the spring plunger 472 and member 474 with the grooves/recesses 476, one or more of the other components (e.g., 404, 408, 412, 416, 420, etc.) of the wheeled shovel 400 may be configured similar to the corresponding other components of the wheeled shovel 100 in at least some embodiments thereof.

Figure 18:
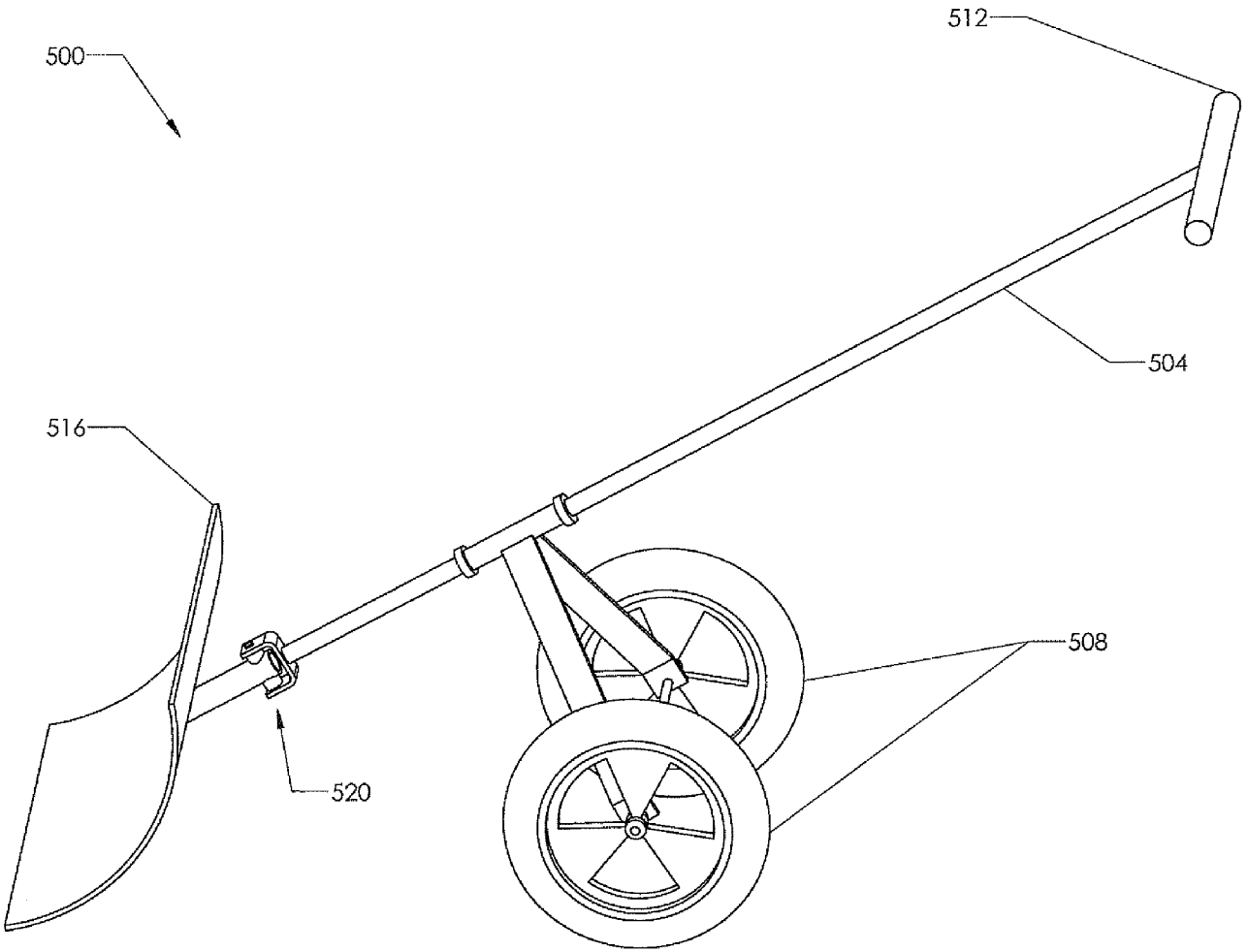
FIG. 18 is an upper perspective view of another exemplary embodiment of a wheeled shovel having two wheels, a frame, a pivotable/steerable shovel blade, and a swivel pivotably coupling the shovel blade to the frame according to an exemplary embodiment.
Figure 19:
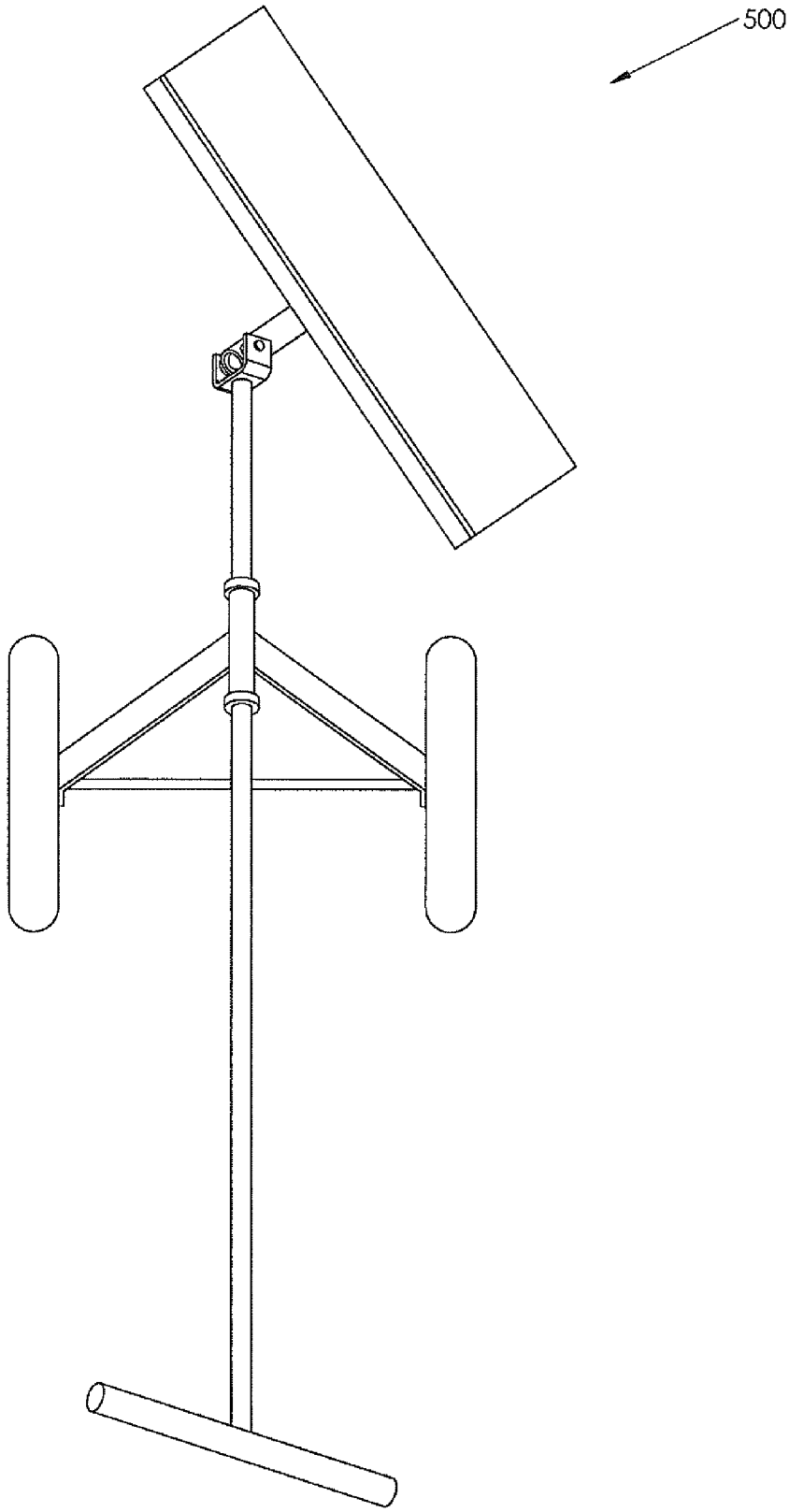
FIG. 19 is an upper view of the wheeled shovel shown in FIG. 18 with the shovel blade pivoted or steered to the right relative to the forward direction of travel of the wheeled shovel.

FIGS. 18 and 19 illustrate another exemplary embodiment of a wheeled shovel 500 embodying one or more aspects of the present disclosure. As shown, the wheeled shovel 500 generally includes a frame, driving member, or longitudinal chassis member 504, two wheels 508, a handle 512, a shovel blade or plow 516, and a pivot or swivel 520. The pivot 520 couples the shovel blade 516 to the frame 504 such that the shovel blade 516 is pivotable about a pivot axis. The wheeled shovel 500 may be configured such that the shovel blade 516 may be steered or dynamically pivoted (and remain in that pivoted position) about the pivot axis towards the left or right direction by a force applied to the shovel blade 516 that is generated as the wheeled shovel 500 is traveling in the forward direction with the frame 504 leaning to the same left or right direction.

Other than having two wheels 508 (instead of a single wheel 108), one or more of the other components (e.g., 504, 508, 512, 516, 520, etc.) of the wheeled shovel 500 may be configured similar to the corresponding other components of the wheeled shovel 100 in at least some embodiments thereof.

FIGS. 20 through 23 illustrate another exemplary embodiment of a wheeled shovel 600 embodying one or more aspects of the present disclosure. As shown, the wheeled shovel 600 generally includes a frame, driving member, or longitudinal chassis member 604, a wheel 608, a handle 612, a shovel blade or plow 616 pivotably coupled to the frame 604 such that the shovel blade 616 is steerable or pivotable about a pivot axis. The wheeled shovel 600 may be configured such that the shovel blade 616 may be steered or dynamically pivoted (and remain in that pivoted position) about the pivot axis towards the left or right direction by a force applied to the shovel blade 616 that is generated as the wheeled shovel 600 is traveling in the forward direction with the frame 604 leaning to the same left or right direction.

Figure 21:
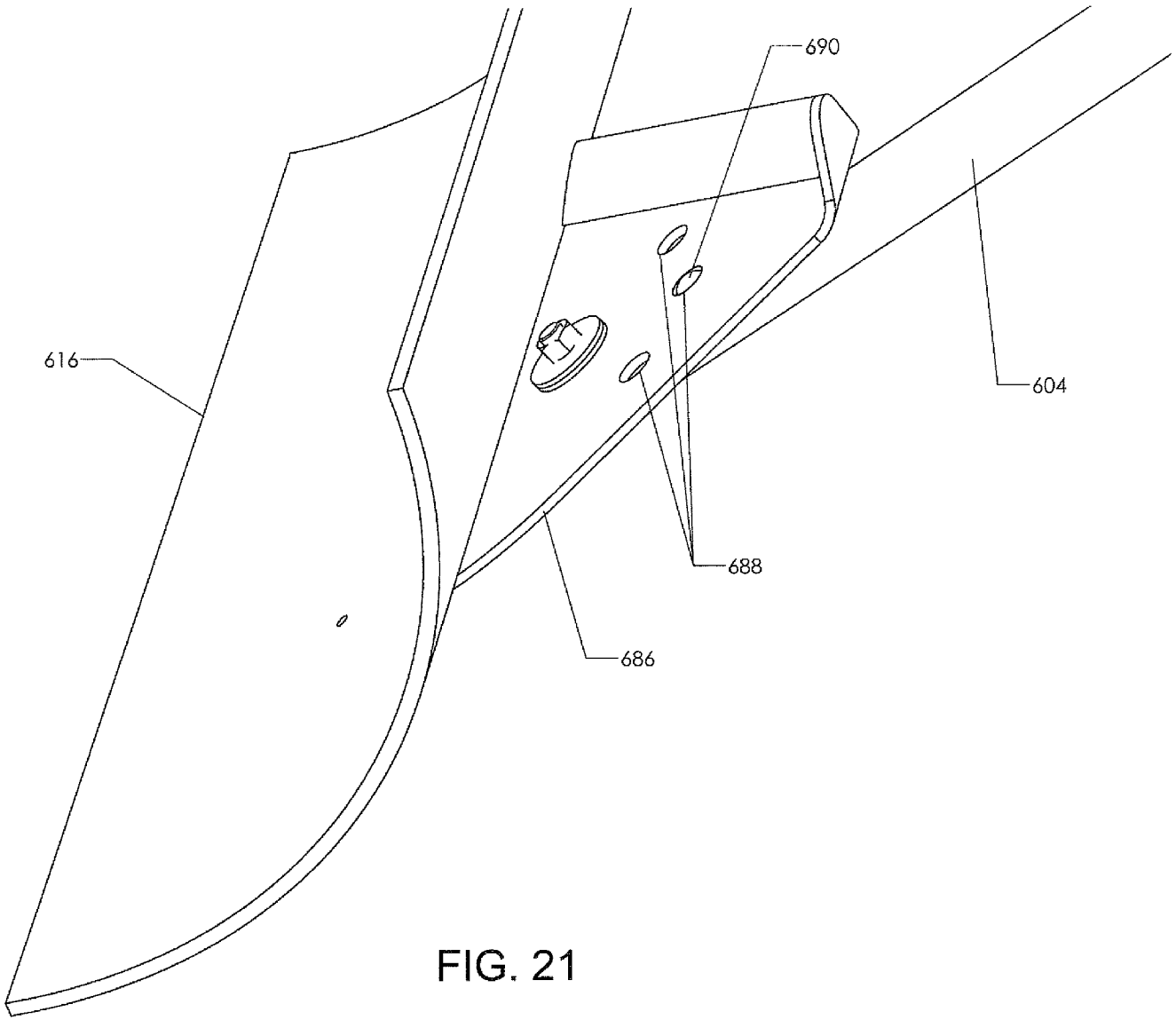
FIG. 21 is an upper partial perspective view of the wheeled shovel in FIG. 20, and illustrating the coupling of the shovel blade to the frame according to an exemplary embodiment.

In this particular embodiment, the wheeled shovel 600 also includes a detent or resistant mechanism (FIG. 23) for providing resistance to inhibit pivotal movement of the shovel blade relative to the frame once the detent or resistance mechanism has been engaged. As shown in FIG. 23, a plate or other member 686 may be associated (e.g., attached, integrally formed with, etc.) with the shovel blade 616. The plate 686 may include one or more openings 688 (e.g., holes, notches, recesses, etc.) each of which is associated with a corresponding pivotal position (e.g., neutral, unpivoted position, left position, right position, etc.) of the shovel blade 616 relative to the frame 604. In this particular embodiment as shown in FIG. 21, the plate 686 includes three holes 688 that are respectively associated with left, neutral/unpivoted, and right positions. Alternative embodiments may include more or less than three holes 688.

With continued reference to FIG. 23, a ball 690 may have an inner portion disposed within the tubular frame 604. The ball 690 may also have outer portion that protrudes outwardly beyond an opening in the frame 604. A spring (or other biasing device) 692 is also disposed within the tubular frame 604. The spring 692 may be engaged with the inner portion of the ball 690 for biasing the ball 690 in a direction towards the holes 688 for engagement with one of the holes 688. The engagement of the ball's outer portion within one of the holes 688 may thus inhibit pivotal movement of the shovel blade 616 relative to the frame 604.

The spring 692 may be configured such that the ball 690 automatically disengages from one of the three holes 688 upon generation of a sufficient force on the shovel blade 616 for overcoming the spring biasing force. With the disengagement of the ball 690 from the one of the holes 688, the shovel blade 616 may be pivotable about the pivot axis relative to the frame 604. In some embodiments, the ball 690 (after disengagement from the hole 688) may remain in contact (and produce frictional resistance) with the plate 686 as the shovel blade 616 is pivoted, until the ball 690 engages with another hole 688. As the ball 690 rolls or is moved along the plate 686 between the holes 688, the frictional resistance generated thereby may help provide a more smooth pivoting movement of the shovel blade and/or inhibit the shovel blade from flopping around too much.

Other than the detent or resistance mechanism (e.g., plate 686, holes 688, ball 690, spring 692, etc.), one or more of the other components (e.g., 604, 608, 612, 616, etc.) of the wheeled shovel 600 may be configured similar to the corresponding other components of the wheeled shovel 100 in at least some embodiments thereof.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A wheeled shovel comprising:

a frame having an upper portion, a lower portion, and a medial portion;

a wheel coupled to the frame at about the medial portion;

a handle disposed at about the upper portion of the frame;

a shovel blade; and a pivot coupling the shovel blade to the lower portion of the frame, the pivot configured to allow the shovel blade to pivot relative to the frame about a pivot axis that is not perpendicular to a forward direction of travel of the wheeled shovel;

whereby the wheeled shovel is configured such that the shovel blade is pivotable about the pivot axis towards the left or right direction relative to the forward direction when the wheeled shovel is traveling in the forward direction with the frame leaning in the same left or right direction.

2. The wheeled shovel of claim 1, wherein the pivot axis is generally perpendicular to a longitudinal axis of the frame.

3. The wheeled shovel of claim 1, wherein the pivot axis forms an acute angle with a surface supporting the wheeled shovel relative to the front of the wheeled shovel.

4. The wheeled shovel of claim 3, wherein the acute angle is about sixty degrees.

5. The wheeled shovel of claim 1, wherein the wheeled shovel is configured such that the shovel blade remains pivoted towards the left or right direction, without having to mechanically lock the shovel blade in place, by virtue of a force applied to the shovel blade that is generated as the wheeled shovel is traveling in the forward direction with the frame leaning to the same left or right direction in which the shovel blade is pivoted.

6. The wheeled shovel of claim 1, wherein the pivot axis is tilted in a direction towards the forward direction of travel of the wheeled shovel.

7. The wheeled shovel of claim 1, wherein the wheeled shovel is configured such that the shovel blade dynamically pivots about the pivot axis towards the left or right direction upon application of a force to the shovel blade that is generated as the wheeled shovel is traveling in the forward direction with the frame leaning to the same left or right direction in which the shovel blade is pivoted.

8. The wheeled shovel of claim 1, wherein the frame includes a generally straight elongate member that is generally slanted relative to the forward direction of travel of the wheeled shovel, and wherein the wheeled shovel further comprises a member having a first end portion coupled to the frame and a second end portion coupled to the wheel such that the wheel is closer to the front of the frame than the rear of the frame and such that the wheel is generally centered directly underneath the generally straight elongate member.

9. The wheeled shovel of claim 1, wherein the wheeled shovel includes either a single wheel or two spaced-apart wheels.

10. The wheeled shovel of claim 1, wherein the pivot comprises a swivel of a caster.

11. The wheeled shovel of claim 1, wherein the shovel blade includes a leading edge having a bottom surface, and wherein the wheeled shovel is configured such that the shovel blade is pivotable about the pivot axis, while the wheel and the lower surface of the shovel blade's leading edge maintain substantial contact with a surface supporting the wheeled shovel.

12. The wheeled shovel of claim 1, wherein the handle includes a cross-bar having right and left end portions extending outwardly beyond the frame in the respective right and left directions.

13. The wheeled shovel of claim 1, further comprising means for biasing the shovel blade into a neutral, unpivoted position relative to the frame.

14. The wheeled shovel of claim 1, further comprising a return spring for applying a spring biasing force for biasing the shovel blade into a neutral, unpivoted position relative to the frame.

15. The wheeled shovel of claim 1, further comprising a detent for helping retain the shovel blade in a neutral, unpivoted position relative to the frame, wherein the detent is configured to automatically disengage upon generation of a sufficient force on the shovel blade, whereupon disengagement of the detent, the shovel blade is pivotable about the pivot axis out of the neutral, unpivoted position.

16. The wheeled shovel of claim 1, further comprising a detent for helping retain the shovel blade in and bias the shovel blade towards at least one position relative to the frame.

17. The wheeled shovel of claim 1, further comprising a resistance mechanism for biasing the shovel blade towards at least one position relative to the frame.

18. The wheeled shovel of claim 1, further comprising a resistance mechanism for helping retain the shovel blade in at least one position relative to the frame and inhibit pivotal movement of the shovel blade relative to the frame when the shovel blade is in said at least one position.

19. The wheeled shovel of claim 1, further comprising:

one or more openings each associated with a corresponding pivotal position of the shovel blade relative to the frame;

a ball having an inner portion disposed within the frame and an outer portion protruding outwardly beyond an opening in the frame;

a spring within the frame engaged with the inner portion of the ball for biasing the ball in a direction towards the openings associated with the shovel blade pivot;

whereby engagement of the ball's outer portion within one of said one or more openings inhibits pivotal movement of the shovel blade relative to the frame.

20. A wheeled shovel comprising:

a frame having an upper portion, a lower portion, and a medial portion;

a wheel coupled to the frame at about the medial portion;

a handle disposed at about the upper portion of the frame;

a shovel blade; and a pivot coupling the shovel blade to the lower portion of the frame, the pivot configured to allow the shovel blade to pivot relative to the frame about a pivot axis that is not perpendicular to a forward direction of travel of the wheeled shovel;

a spring plunger coupled to one of the frame and the shovel blade; and at least one recess associated with the other one of said frame and said shovel blade;

the spring plunger including a plunger having a first end portion and spring that applies a spring biasing force for biasing the plunger's first end portion into engagement with the recess, whereupon engagement of the plunger's first end portion with the recess helps retain the relative positioning of the shovel blade to the frame;

whereby the wheeled shovel is configured such that the shovel blade is pivotable about the pivot axis towards the left or right direction relative to the forward direction when the wheeled shovel is traveling in the forward direction with the frame leaning in the same left or right direction;

21. The wheeled shovel of claim 20, wherein the at least one recess includes a plurality of recesses each associated with a different position of the shovel blade pivoted relative to the frame.

22. The wheeled shovel of claim 21, wherein the spring plunger is configured such that the plunger's first end portion automatically disengages from the recess upon generation of a sufficient force on the shovel blade for overcoming the spring biasing force, whereupon disengagement of the plunger's first end portion from the recess, the shovel blade is pivotable about the pivot axis.

23. The wheeled shovel of claim 21, wherein:

the spring plunger includes a second end portion generally opposite the first end portion; and the plunger's first end portion is disengagable from the recess when the plunger's second end portion is pulled in a direction generally away from the recess with sufficient force for overcoming the spring biasing force, whereupon disengagement of the plunger's first end portion from the recess, the shovel blade is pivotable about the pivot axis.

24. A method of using a shovel having a frame and a shovel blade pivotably movable relative to the frame about a pivot axis that is not perpendicular to a forward direction of travel of the shovel, the method comprising:

leaning the frame towards the left or right direction and moving the shovel in a forward direction, to thereby dynamically pivot the shovel blade about the pivot axis towards the same left or right direction in which the frame is leaning; and maintaining the shovel blade pivoted to the left or right direction without locking the shovel blade, by application of a force to the shovel blade that is generated as the shovel continues to move in the forward direction with the frame leaning.

25. An apparatus comprising:

a frame having an upper portion and a lower portion;

a handle disposed at about the upper portion of the frame;

a tool; and a pivot coupling the tool to the lower portion of the frame, the pivot configured to allow the tool to pivot relative to the frame about a pivot axis that is not perpendicular to, but tilted in a direction towards, a forward direction of travel of the apparatus;

whereby the apparatus is configured such that the tool dynamically pivots and remains pivoted about the pivot axis towards the left or right direction relative to the forward direction by a force applied to the tool that is generated as the apparatus is traveling in the forward direction with the frame leaning to the same left or right direction.

26. The apparatus of claim 25, further comprising a wheel coupled to the frame.

27. The apparatus of claim 25, wherein the tool comprises one of a shovel blade, a snow plow, and a scraper.

* * * * *